US011274863B2

(12) United States Patent
Shirasaki et al.

(10) Patent No.: US 11,274,863 B2
(45) Date of Patent: Mar. 15, 2022

(54) AIR CONDITIONING SYSTEM

(71) Applicant: Daikin Industries, LTD., Osaka (JP)

(72) Inventors: Tetsuya Shirasaki, Osaka (JP); Atsushi Yoshimi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/649,733

(22) PCT Filed: Jul. 20, 2018

(86) PCT No.: PCT/JP2018/027340
§ 371 (c)(1),
(2) Date: Mar. 23, 2020

(87) PCT Pub. No.: WO2019/064850
PCT Pub. Date: Apr. 4, 2019

(65) Prior Publication Data

US 2020/0256598 A1 Aug. 13, 2020

(30) Foreign Application Priority Data

Sep. 29, 2017 (JP) ..... JP2017-190406

(51) Int. Cl.
*F25B 41/40* (2021.01)
*F25B 13/00* (2006.01)
*F25B 43/00* (2006.01)

(52) U.S. Cl.
CPC ..... *F25B 41/40* (2021.01); *F25B 13/00* (2013.01); *F25B 43/006* (2013.01); *F25B 2313/006* (2013.01); *F25B 2313/0233* (2013.01)

(58) Field of Classification Search
CPC ..... F25B 41/40; F25B 41/42; F25B 41/45; F25B 41/48; F25B 43/006;
(Continued)

(56) References Cited

U.S. PATENT DOCUMENTS 2,082,403 A * 6/1937 Larkin ..... F25B 39/028 138/37
5,148,597 A * 9/1992 Weeks ..... F01N 13/08 29/463
(Continued)

FOREIGN PATENT DOCUMENTS

EP 2667105 A1 11/2013
JP H02195159 A 8/1990
(Continued)

OTHER PUBLICATIONS

International Search Report issued in International Application No. PCT/JP2018/027340, dated Oct. 23, 2018 (3 pages).
(Continued)

*Primary Examiner* — Jianying C Atkisson
*Assistant Examiner* — Miguel A Diaz
(74) *Attorney, Agent, or Firm* — Osha Bergman Watanabe & Burton LLP

(57) ABSTRACT

An air-conditioning system that performs a refrigeration cycle in a refrigerant circuit, includes: an outdoor unit; a plurality of indoor units; and a connection pipe disposed between the outdoor unit and the indoor units and that forms at least a refrigerant passage through which refrigerant in a gas-liquid two-phase state flows. The connection pipe includes: a branch portion that includes an indoor-side pipe group including indoor-side pipes that each communicates with any one of the indoor units, and diverges refrigerant flowing from the outdoor unit side; and a trap portion disposed in at least any one of the indoor-side pipes and is filled with refrigerant in a gas state.

9 Claims, 18 Drawing Sheets

(58) Field of Classification Search
CPC ..... F25B 2313/006; F25B 2313/007; F25B 2313/023; F25B 2313/0233
See application file for complete search history.

(56) References Cited

U.S. PATENT DOCUMENTS

| | | | | |
|---|---|---|---|---|
| 5,794,452 | A * | 8/1998 | Black | F25B 41/20 62/73 |
| 5,927,093 | A * | 7/1999 | Noguchi | F24F 1/32 62/259.1 |
| 6,023,940 | A * | 2/2000 | Abbott | B01F 5/0682 210/445 |
| 6,216,817 | B1 * | 4/2001 | Kannon | G10K 11/16 181/175 |
| 6,427,484 | B1 * | 8/2002 | Choi | F24F 1/32 62/640 |
| 7,036,328 | B2 * | 5/2006 | Shin | F25B 13/00 62/115 |
| 7,152,885 | B2 * | 12/2006 | Takamatsu | B60H 1/00571 285/124.1 |
| 7,350,823 | B2 * | 4/2008 | Ichimura | B21D 41/021 285/122.1 |
| 7,600,393 | B2 * | 10/2009 | Kim | F25B 41/40 62/504 |
| 8,091,377 | B2 * | 1/2012 | Jeong | F25B 13/00 62/324.6 |
| 8,966,923 | B2 * | 3/2015 | Haussmann | F25B 41/31 62/299 |
| 9,605,862 | B2 * | 3/2017 | Eguchi | F25B 13/00 |
| 9,851,132 | B2 * | 12/2017 | Kawano | F25B 13/00 |
| 10,415,860 | B2 * | 9/2019 | Tanaka | F25B 13/00 |
| 10,443,866 | B2 * | 10/2019 | Nakatsu | F24F 3/065 |
| 10,557,648 | B2 * | 2/2020 | Naito | F25B 13/00 |
| 10,907,871 | B2 * | 2/2021 | Kinoshita | F25B 41/40 |
| 2003/0230107 | A1 * | 12/2003 | Lee | F25B 13/00 62/324.6 |
| 2005/0050911 | A1 * | 3/2005 | Shin | F25B 13/00 62/324.6 |
| 2005/0161943 | A1 * | 7/2005 | Takamatsu | F16L 39/00 285/131.1 |
| 2006/0201197 | A1 * | 9/2006 | Kim | F25B 41/40 62/504 |
| 2007/0113582 | A1 * | 5/2007 | Sao | F25B 41/40 62/498 |
| 2009/0241577 | A1 * | 10/2009 | Fukushima | F25B 13/00 62/259.1 |
| 2010/0199695 | A1 * | 8/2010 | Shinozaki | F24F 3/065 62/238.7 |
| 2011/0023512 | A1 * | 2/2011 | Kawagoe | F25B 13/00 62/196.1 |
| 2011/0061413 | A1 * | 3/2011 | Setoguchi | F24F 3/065 62/238.7 |
| 2011/0219804 | A1 * | 9/2011 | Park | F25B 41/40 62/259.1 |
| 2012/0292006 | A1 * | 11/2012 | Yamashita | F24F 3/06 165/200 |
| 2015/0211802 | A1 * | 7/2015 | Yokozeki | F28F 1/325 165/104.14 |
| 2015/0285530 | A1 * | 10/2015 | Honda | F24F 11/89 62/216 |
| 2015/0292780 | A1 * | 10/2015 | Kitamura | F25B 5/04 62/324.1 |
| 2015/0300666 | A1 * | 10/2015 | Kawano | F24F 5/001 62/324.1 |
| 2015/0345842 | A1 * | 12/2015 | Kawano | F24F 3/08 62/196.1 |
| 2016/0003488 | A1 * | 1/2016 | Nakatsu | F24F 3/065 137/375 |
| 2016/0146496 | A1 * | 5/2016 | Yamashita | F25B 49/02 62/190 |
| 2016/0341453 | A1 * | 11/2016 | Yamashita | F25B 43/006 |
| 2016/0356516 | A1 * | 12/2016 | Eguchi | F25B 40/02 |
| 2017/0010027 | A1 * | 1/2017 | Liu | F25B 43/02 |
| 2017/0067697 | A1 * | 3/2017 | Xue | F28F 9/0275 |
| 2017/0198946 | A1 * | 7/2017 | Takenaka | F25B 41/20 |
| 2018/0017293 | A1 * | 1/2018 | Naito | F24F 11/36 |
| 2018/0112899 | A1 * | 4/2018 | Masahiro | F25B 41/31 |
| 2018/0195783 | A1 * | 7/2018 | Jung | F24F 11/67 |
| 2018/0216858 | A1 * | 8/2018 | Higashiiue | F28F 9/02 |
| 2018/0274829 | A1 * | 9/2018 | Thobias | F25B 49/02 |
| 2018/0335174 | A1 * | 11/2018 | Kakinuma | F16L 41/021 |
| 2019/0048240 | A1 * | 2/2019 | Tanaka | F25B 45/00 |
| 2019/0063792 | A1 * | 2/2019 | Kim | F24F 11/67 |
| 2019/0093931 | A1 * | 3/2019 | Kinoshita | F24F 1/32 |
| 2019/0113244 | A1 * | 4/2019 | Akaiwa | F24F 1/26 |
| 2019/0376727 | A1 * | 12/2019 | Tamura | F25B 13/00 |
| 2019/0383522 | A1 * | 12/2019 | Shiohama | F24F 1/0068 |
| 2020/0116400 | A1 * | 4/2020 | Kojima | F25B 41/26 |
| 2020/0166257 | A1 * | 5/2020 | Wada | F25B 49/02 |
| 2020/0182516 | A1 * | 6/2020 | Maruyama | F25B 13/00 |
| 2020/0271333 | A1 * | 8/2020 | Miyawaki | F25B 13/00 |
| 2020/0271344 | A1 * | 8/2020 | Ikeda | F25B 41/22 |
| 2020/0284444 | A1 * | 9/2020 | Shirasaki | F16L 55/24 |
| 2020/0393178 | A1 * | 12/2020 | Kumakura | C09K 5/045 |
| 2021/0123638 | A1 * | 4/2021 | Yoshioka | F28F 1/325 |
| 2021/0131706 | A1 * | 5/2021 | Yamada | F24F 11/62 |

FOREIGN PATENT DOCUMENTS

| | | | | |
|---|---|---|---|---|
| JP | 2002243314 | A * | 8/2002 | F25B 41/40 |
| JP | 2005221167 | A | 8/2005 | |
| JP | 2016138711 | A | 8/2016 | |
| JP | 2017150706 | A | 8/2017 | |
| JP | 2018040548 | A * | 3/2018 | F25B 5/02 |
| JP | 2019066081 | A | 4/2019 | |
| WO | 2015/029160 | A1 | 3/2015 | |
| WO | WO-2019167909 | A1 * | 9/2019 | F25B 41/40 |

OTHER PUBLICATIONS

International Preliminary Report on Patentability issued in corresponding International Patent Application No. PCT/JP2018/027340, dated Apr. 9, 2020 (5 pages).

Notification of Reasons for Refusal issued in Japanese Patent Application No. 2018-136481, dated Oct. 16, 2018 (6 pages).

Extended European Search Report issued in the counterpart European Patent Application No. 18860938.2, dated Oct. 16, 2020 (7 pages).

Extended European Search Report issued in corresponding European Patent Application No. 21171171.8, dated Sep. 1, 2021 (7 pages).

* cited by examiner

AIR CONDITIONING SYSTEM

TECHNICAL FIELD

The present invention relates to an air-conditioning system.

BACKGROUND

Hitherto, an air-conditioning system including an outdoor unit and a plurality of indoor units is known. For example, PTL 1 (International Publication No. 2015/029160) describes an air-conditioning system in which a single outdoor unit and a plurality of indoor units are connected via a connection pipe. In PTL 1, the connection pipe is branched into some numbers of connection pipes according to the number of the indoor units.

As for refrigerant that is transferred through a liquid-side refrigerant passage running between an outdoor unit and indoor units, it is possible to perform operation with a smaller amount of refrigerant filled (the amount of refrigerant filled in a refrigerant circuit) in the case of gas-liquid two-phase transfer to transfer refrigerant in a gas-liquid two-phase state as compared to the case of liquid transfer to transfer refrigerant in a liquid state, so employing the gas-liquid two-phase transfer can be regarded as a method of achieving refrigerant saving. In PTL 1, gas-liquid two-phase transfer is performed by disposing a pressure reducing valve in the outdoor unit.

Here, in the case where the amount of refrigerant filled is reduced by performing gas-liquid two-phase transfer, when some of the indoor units are in an operating state and the other indoor units are in an operation stop state (a state where an operation start command is not input or an operation suspension state, such as thermo-off), it is presumable that the amount of circulating refrigerant is not normally ensured in the indoor units in an operating state (operating indoor units) and, as a result, reliability decreases. In other words, since the amount of refrigerant filled when gas-liquid two-phase transfer is performed is less than the amount of refrigerant filled when liquid transfer is performed, when refrigerant to be fed to the operating indoor units flows from a branch part into indoor-side pipes that communicate with the non-operating indoor units, it is presumable that the amount of circulating refrigerant is not normally ensured in the operating indoor units and, as a result, reliability decreases. An air-conditioning system that minimizes a decrease in reliability is provided.

SUMMARY

An air-conditioning system according to one or more embodiments of the present invention is an air-conditioning system configured to perform a refrigeration cycle in a refrigerant circuit, and includes an outdoor unit, a plurality of indoor units, and a connection pipe. The connection pipe is disposed between the outdoor unit and the indoor units. The connection pipe at least forms a refrigerant passage through which gas-liquid two-phase refrigerant flows. The connection pipe includes a branch portion and a trap portion. The branch portion includes an indoor-side pipe group. The indoor-side pipe group is a plurality of indoor-side pipes each communicating with any one of the indoor units. The branch portion is configured to diverge refrigerant flowing from the outdoor unit side. The trap portion is provided in at least any one of the indoor-side pipes. The trap portion is configured to be filled with refrigerant in a gas state.

With the air-conditioning system according to one or more embodiments, in the air-conditioning system in which refrigerant in a gas-liquid two-phase state passes through the connection pipe connecting the outdoor unit and the indoor units, the trap portion is provided in the indoor-side pipe(s) included in the connection pipe (branch portion). Thus, in the case where the amount of refrigerant filled is reduced as compared to the existing one by performing gas-liquid two-phase transfer, when part of the indoor units (operating indoor unit(s)) is/are in an operating state and the other indoor unit(s) (stopped indoor unit(s)) is/are in an operation stop state, gas refrigerant can be filled in the trap portion(s) (of the indoor-side pipe(s) communicating with the stopped indoor unit(s)). As a result, flow of refrigerant to the stopped indoor unit(s) can be suppressed. Thus, a shortage of the amount of circulating refrigerant in the operating indoor unit(s) can be suppressed. Therefore, a decrease in reliability is minimized.

The "operation stop state" here contains not only a state where an operation stop command is input and the operation is stopped, a state where the operation is stopped as a result of cutting off the power, and a state where an operation start command is not input and the operation is not performed but also a state where the operation is temporarily stopped by thermo-off, or the like.

An air-conditioning system according to one or more embodiments further includes a pressure reducing valve. The pressure reducing valve is configured to decompress refrigerant such that refrigerant flowing from the outdoor unit to the indoor units passes through the connection pipe in a gas-liquid two-phase state.

In an air-conditioning system according to one or more embodiments, the trap portion is provided in one of the indoor-side pipes, including a portion of which an installation level is lower than an other one of the indoor-side pipes of the indoor-side pipe group.

In an air-conditioning system according to one or more embodiments, the indoor units include a first indoor unit and a second indoor unit. An installation level of the second indoor unit is lower than an installation level of the first indoor unit. The indoor-side pipe group includes a first indoor-side pipe and a second indoor-side pipe. The first indoor-side pipe communicates with the first indoor unit. The second indoor-side pipe communicates with the second indoor unit. The trap portion is provided in the second indoor-side pipe.

In an air-conditioning system according to one or more embodiments, the connection pipe includes a plurality of the branch portions. The trap portion is provided in the indoor-side pipe included in the branch portion closest to the outdoor unit.

In an air-conditioning system according to one or more embodiments, the trap portion has an upward extended portion. The upward extended portion extends upward. The upward extended portion is disposed in the associated indoor-side pipes.

An air-conditioning system according to one or more embodiments further includes a branch pipe unit. The branch pipe unit is preassembled and connected to another pipe on an installation site. The branch pipe unit is part or all of the branch portion. The branch pipe unit includes a main pipe and a connection pipe. The main pipe communicates with the indoor-side pipe group. The main pipe is located on the outdoor unit side with respect to the indoor-side pipe group in the refrigerant circuit. The connection pipe connects the main pipe and the indoor-side pipe group. The connection pipe is configured to diverge refrigerant flowing from the main pipe to the indoor-side pipe group. An extending direction of each of the main pipe and the connection pipe is a horizontal direction.

An air-conditioning system according to one or more embodiments further includes a branch pipe unit. The branch pipe unit is preassembled and connected to another pipe on an installation site. The branch pipe unit is part or all of the branch portion. The branch pipe unit includes a main pipe and a connection pipe. The main pipe communicates with the indoor-side pipe group. The main pipe is located on the outdoor unit side with respect to the indoor-side pipe group in the refrigerant circuit. The connection pipe connects the main pipe and the indoor-side pipe group. The connection pipe is configured to diverge refrigerant flowing from the main pipe to the indoor-side pipe group. An extending direction of each of the main pipe and the connection pipe is a vertical direction. The upward extended portion is disposed over the main pipe, the connection pipe, and the associated indoor-side pipes.

An air-conditioning system according to one or more embodiments further includes a branch pipe unit. The branch pipe unit is preassembled and connected to another pipe on an installation site. The branch pipe unit is part or all of the branch portion. The branch pipe unit includes a main pipe and a connection pipe. The main pipe communicates with the indoor-side pipe group. The main pipe is located on the outdoor unit side with respect to the indoor-side pipe group in the refrigerant circuit. The connection pipe connects the main pipe and the indoor-side pipe group. The connection pipe is configured to diverge refrigerant flowing from the main pipe to the indoor-side pipe group. An extending direction of the main pipe is a horizontal direction. An extending direction of the connection pipe is a vertical direction. The upward extended portion is disposed over the connection pipe and the associated indoor-side pipes.

An air-conditioning system according to one or more embodiments further includes a branch pipe unit. The branch pipe unit is preassembled and connected to another pipe on an installation site. The branch pipe unit is part or all of the branch portion. The branch pipe unit includes a main pipe and a connection pipe. The main pipe communicates with the indoor-side pipe group. The main pipe is located on the outdoor unit side with respect to the indoor-side pipe group in the refrigerant circuit. The connection pipe connects the main pipe and the indoor-side pipe group. The connection pipe is configured to diverge refrigerant flowing from the main pipe to the indoor-side pipe group. The main pipe extends along a downward direction. The connection pipe includes a turnaround portion. The turnaround portion turns refrigerant, flowing from the main pipe, around to an upward direction. The upward extended portion is disposed over the connection pipe and the associated indoor-side pipes.

DETAILED DESCRIPTION

Hereinafter, an air-conditioning system 100 according to one or more embodiments of the present invention will be described. The following embodiments are specific examples and do not limit the technical scope. The following embodiments may be modified as needed without departing from the purport. In the following description, upper, lower, right, left, front, and rear directions are directions indicated in FIG. 2, and FIG. 6 to FIG. 9.

In the present invention, a "horizontal direction" includes a right-left direction and a front-rear direction. The "horizontal direction" includes not only a complete horizontal direction but also a direction that inclines within the range of a predetermined angle (for example, 30 degrees) with respect to a horizontal line.

In the present invention, a "vertical direction" includes an up-down direction. The "vertical direction" includes not only a complete vertical direction but also a direction that inclines within the range of a predetermined angle (for example, 45 degrees) with respect to a vertical line.

In the present invention, a "right angle" includes not only a completely right angle (90 degrees) but also "substantially a right angle" (an angle that varies within the range of a predetermined angle (30 degrees) with respect to 90 degrees.

In the present invention, an "operation stop state" includes not only a state where an operation stop command is input and the operation is stopped, a state where the operation is stopped as a result of cutting off the power, and a state where an operation start command is not input and the operation is not performed but also a state where the operation is temporarily stopped by thermo-off, or the like.

In the present invention, it is assumed that a "method" appropriate for an installation environment and design specifications is selected as needed for "joining" and "connection" of portions. The "method" is not limited, and, for example, brazing connection, flaring connection, flange connection, or the like, is assumed.

(1) Outline of Air-Conditioning System 100

Figure 1:
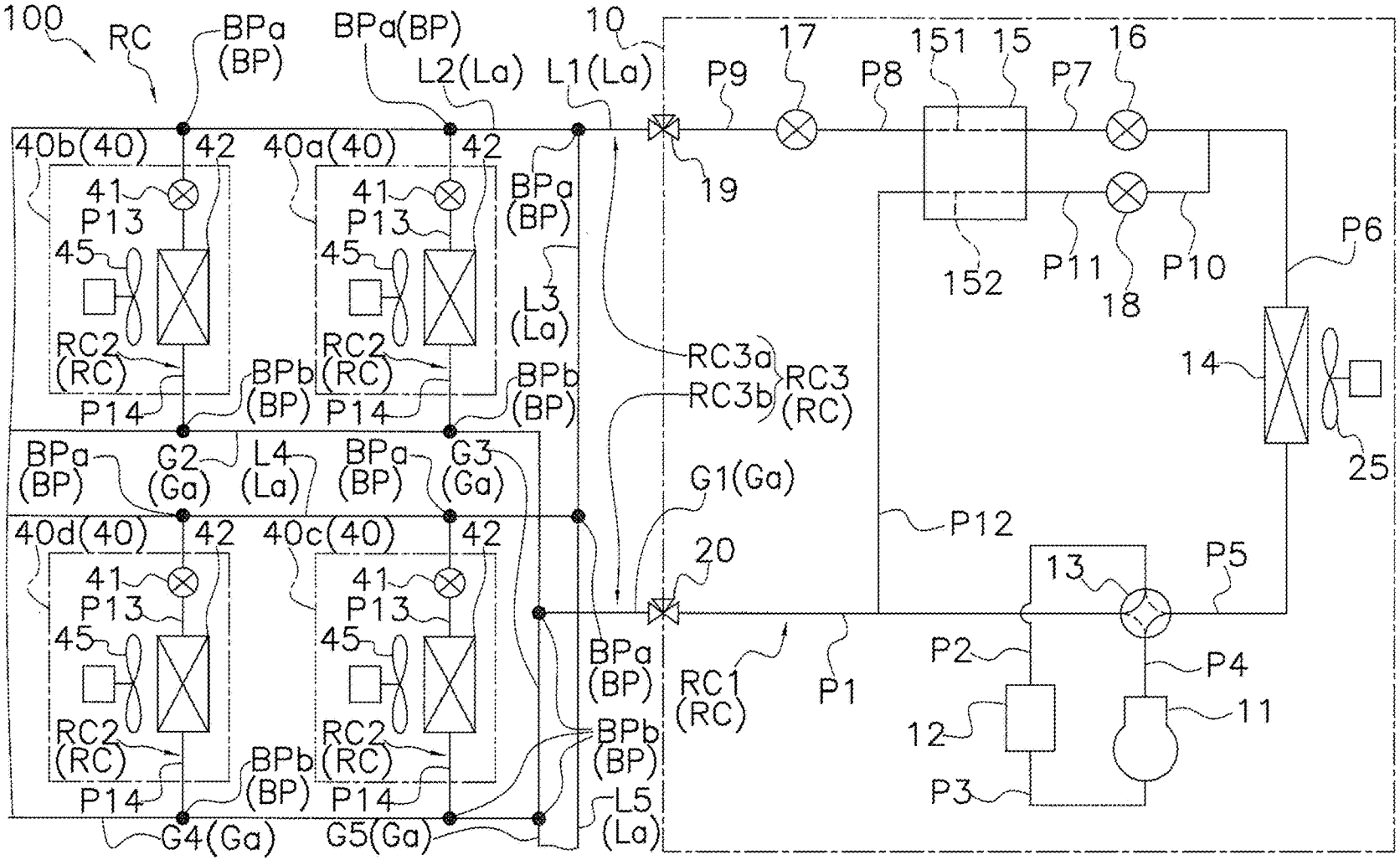
FIG. 1 is a schematic configuration diagram of an air-conditioning system.
Figure 2:
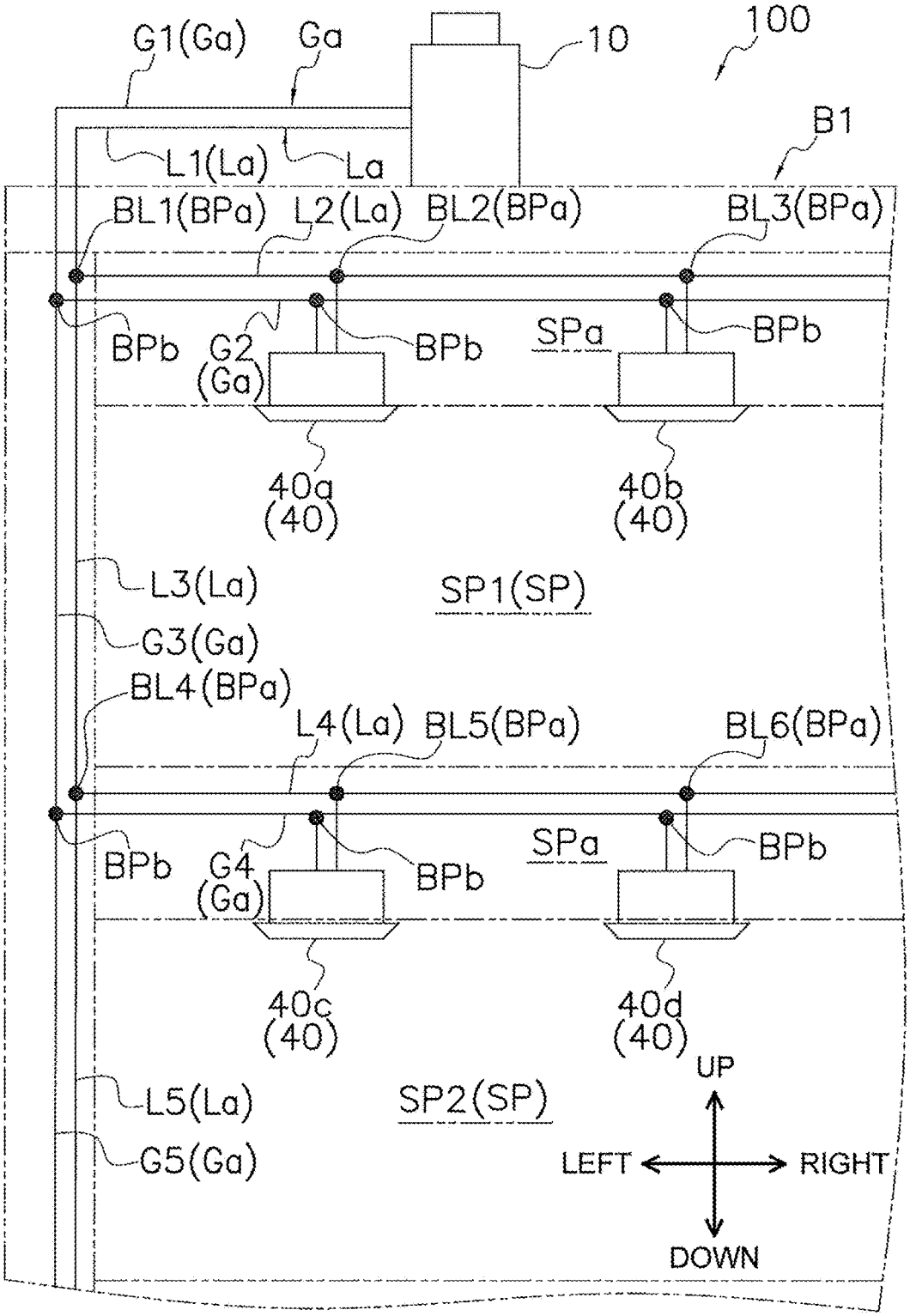
FIG. 2 is a schematic configuration diagram of the air-conditioning system.

FIG. 1 is a schematic configuration diagram of the air-conditioning system 100. FIG. 2 is a schematic application diagram of the air-conditioning system 100. The air-conditioning system 100 is installed in a building, a factory, or the like, and realizes air conditioning in an object space SP. In one or more embodiments, as shown in FIG. 2, the air-conditioning system 100 conditions air in rooms (such as object spaces SP1, SP2) in a multistory building B1. The number of floors, the number of rooms, or the like, of the building B1 may be changed as needed. The air-conditioning system 100, for example, cools or heats object spaces by performing a refrigeration cycle in a refrigerant circuit RC.

The air-conditioning system 100 mainly includes an outdoor unit 10, a plurality of (here, four or more) indoor units 40 (40*a*, 40*b*, 40*c*, 40*d*, . . . ), and a liquid-side connection pipe La and a gas-side connection pipe Ga that connect the outdoor unit 10 and the indoor units 40.

In the air-conditioning system 100, the refrigerant circuit RC is formed by connecting the outdoor unit 10 and the indoor units 40 with the liquid-side connection pipe La and the gas-side connection pipe Ga. In the air-conditioning system 100, a vapor compression refrigeration cycle in which refrigerant enclosed in the refrigerant circuit RC is compressed, cooled or condensed, decompressed, heated or evaporated, and then compressed again takes place. Refrigerant filled in the refrigerant circuit RC is not limited, and, for example, R32 is employed.

The refrigerant circuit RC mainly includes an outdoor-side circuit RC1 formed in the outdoor unit 10, an indoor-side circuit RC2 formed in each of the indoor units 40, and a connection circuit RC3 connecting the outdoor-side circuit RC1 and the indoor-side circuits RC2. The connection circuit RC3 includes a liquid-side connection circuit RC3*a* that functions as a liquid-side refrigerant passage between the outdoor unit 10 and the indoor units 40 and a gas-side connection circuit RC3*b* that functions as a gas-side refrigerant passage, between the outdoor unit 10 and the indoor units 40.

In the air-conditioning system 100, gas-liquid two-phase transfer that refrigerant is transferred in a gas-liquid two-phase state is performed in the liquid-side connection pipe La extending between the outdoor unit 10 and the indoor units 40. More specifically, as for refrigerant that is transferred through the liquid-side connection pipe La extending between the outdoor unit 10 and the indoor units 40, in light of the fact that an operation can be performed with a smaller amount of refrigerant filled while a decrease in capacity is minimized when the refrigerant is transferred in a gas-liquid two-phase state as compared to when the refrigerant is transferred in a liquid state, the air-conditioning system 100 is configured such that gas-liquid two-phase transfer is performed in the liquid-side connection circuit RC3*a* to achieve refrigerant saving. The air-conditioning system 100 includes a "pressure reducing valve" (an outdoor second control valve 17 (described later)) for decompressing refrigerant in the outdoor unit 10 in order to realize gas-liquid two-phase transfer.

A thermal load here is a thermal load at which a process is required in the indoor unit(s) 40 in operation (operating indoor unit(s)), and is calculated based on, for example, any one or some or all of a set temperature that is set in the operating indoor unit(s), a temperature in an object space(s) SP in which the operating indoor unit(s) is/are installed, the amount of circulating refrigerant, the number(s) of rotations of an indoor fan(s) 45, the number of rotations of a compressor 11, the capacity of an outdoor heat exchanger 14, the capacity of each indoor heat exchanger 42, and the like.

a) Outdoor Unit 10

The outdoor unit 10 is, for example, installed outdoors, for example, a roof floor or veranda of the building B1, or installed outside the rooms, such as a basement (other than the object spaces SP). The outdoor unit 10 is connected to the plurality of indoor units 40 via the liquid-side connection pipe La and the gas-side connection pipe Ga, and makes up part of the refrigerant circuit RC (outdoor-side circuit RC1).

The outdoor unit 10 mainly includes a plurality of refrigerant pipes (a first pipe P1 to a twelfth pipe P12), the compressor 11, an accumulator 12, a four-way valve 13, the outdoor heat exchanger 14, a subcooler 15, an outdoor first control valve 16, the outdoor second control valve 17, an outdoor third control valve 18, a liquid-side stop valve 19, and a gas-side stop valve 20 as devices that make up the outdoor-side circuit RC1.

The first pipe P1 connects the gas-side stop valve 20 and a first port of the four-way valve 13. The second pipe P2 connects an inlet port of the accumulator 12 and a second port of the four-way valve 13. The third pipe P3 connects an outlet port of the accumulator 12 and a suction port of the compressor 11. The fourth pipe P4 connects a discharge port of the compressor 11 and a third port of the four-way valve 13. The fifth pipe P5 connects a fourth port of the four-way valve 13 and a gas-side outlet/inlet port of the outdoor heat exchanger 14. The sixth pipe P6 connects a liquid-side outlet/inlet port of the outdoor heat exchanger 14 and one end of the outdoor first control valve 16. The seventh pipe P7 connects the other end of the outdoor first control valve 16 and one end of a main passage 151 of the subcooler 15. The eighth pipe P8 connects the other end of the main passage 151 of the subcooler 15 and one end of the outdoor second control valve 17. The ninth pipe P9 connects the other end of the outdoor second control valve 17 and one end of the liquid-side stop valve 19. The tenth pipe P10 connects a portion between both ends of the sixth pipe P6 and one end of the outdoor third control valve 18. The eleventh pipe P11 connects the other end of the outdoor third control valve 18 and one end of a sub-passage 152 of the subcooler 15. The twelfth pipe P12 connects the other end of the sub-passage 152 of the subcooler 15 and a portion between both ends of the first pipe P1. These refrigerant pipes (P1 to P12) each may be actually made up of a single pipe or may be made up of a plurality of pipes connected via a joint, or the like.

The compressor 11 is a device that compresses low-pressure refrigerant into high pressure in the refrigeration cycle. In one or more embodiments, the compressor 11 has a hermetically sealed structure in which a positive-displacement, such as a rotary type and a scroll type, compression element is driven for rotation by a compressor motor (not shown). Here, the compressor motor is able to control operation frequency with an inverter. With this configuration, displacement control over the compressor 11 is enabled.

The accumulator 12 is a tank for restricting excessive suction of liquid refrigerant into the compressor 11. The accumulator 12 has a predetermined volume according to the amount of refrigerant filled in the refrigerant circuit RC.

The four-way valve 13 is a flow switch valve for switching the flow of refrigerant in the refrigerant circuit RC. The four-way valve 13 can be switched between a normal cycle mode and a reverse cycle mode. The four-way valve 13, when in the normal cycle mode, communicates the first port (first pipe P1) with the second port (second pipe P2) and communicates the third port (fourth pipe P4) with the fourth port (fifth pipe P5) (see the solid lines in the four-way valve 13 in FIG. 1). The four-way valve 13, when in the reverse cycle mode, communicates the first port (first pipe P1) with the third port (fourth pipe P4) and communicates the second port (second pipe P2) with the fourth port (fifth pipe P5) (see the dashed lines in the four-way valve 13 in FIG. 1).

The outdoor heat exchanger 14 is a heat exchanger that functions as a condenser (or radiator) or an evaporator (or heater) for refrigerant. The outdoor heat exchanger 14 functions as the condenser for refrigerant during normal cycle operation (operation when the four-way valve 13 is in the normal cycle mode). The outdoor heat exchanger 14 functions as the evaporator for refrigerant during reverse cycle operation (operation when the four-way valve 13 is in the reverse cycle mode). The outdoor heat exchanger 14 includes a plurality of heat transfer tubes and heat transfer fins (not shown). The outdoor heat exchanger 14 is configured such that heat is exchanged between refrigerant in the heat transfer tubes and air (outdoor air flow (described later)) passing around the heat transfer tubes or the heat transfer fins.

The subcooler 15 is a heat exchanger that converts inflow refrigerant into liquid refrigerant in a subcooled state. The subcooler 15 is, for example, a double-tube heat exchanger. The main passage 151 and the sub-passage 152 are formed in the subcooler 15. The subcooler 15 is configured such that refrigerant flowing through the main passage 151 and refrigerant flowing through the sub-passage 152 exchange heat with each other.

The outdoor first control valve 16 is an electronic expansion valve of which the opening degree is controllable. The outdoor first control valve 16 decompresses inflow refrigerant or adjusts the flow rate according to the opening degree. The outdoor first control valve 16 is disposed between the outdoor heat exchanger 14 and the subcooler 15 (main passage 151). In other words, the outdoor first control valve 16 may also be regarded as being disposed between the outdoor heat exchanger 14 and the liquid-side connection pipe La.

The outdoor second control valve 17 (which corresponds to the "pressure reducing valve" in the claims) is an electronic expansion valve of which the opening degree is controllable. The outdoor second control valve 17 decompresses inflow refrigerant or adjusts the flow rate according to the opening degree. The outdoor second control valve 17 is disposed between the subcooler 15 (main passage 151) and the liquid-side stop valve 19. When the opening degree of the outdoor second control valve 17 is controlled, refrigerant flowing from the outdoor unit 10 to the indoor units 40 can be placed in a gas-liquid two-phase state.

The outdoor third control valve 18 is an electronic expansion valve of which the opening degree is controllable. The outdoor third control valve 18 decompresses inflow refrigerant or adjusts the flow rate according to the opening degree. The outdoor third control valve 18 is disposed between the outdoor heat exchanger 14 and the subcooler 15 (sub-passage 152).

The liquid-side stop valve 19 is a manual valve disposed at a connection point between the ninth pipe P9 and the liquid-side connection pipe La. One end of the liquid-side stop valve 19 is connected to the ninth pipe P9, and the other end of the liquid-side stop valve 19 is connected to the liquid-side connection pipe La.

The gas-side stop valve 20 is a manual valve disposed at a connection point between the first pipe P1 and the gas-side connection pipe Ga. One end of the gas-side stop valve 20 is connected to the first pipe P1, and the other end of the gas-side stop valve 20 is connected to the gas-side connection pipe Ga.

The outdoor unit 10 includes an outdoor fan 25 that generates outdoor air flow that passes through the outdoor heat exchanger 14. The outdoor fan 25 is a fan that supplies the outdoor heat exchanger 14 with outdoor air flow as a cooling source or heating source for refrigerant flowing through the outdoor heat exchanger 14. The outdoor fan 25 includes an outdoor fan motor (not shown) that is a drive source, and the start, stop, and number of rotations of the outdoor fan 25 are controlled as needed.

A plurality of outdoor-side sensors (not shown) for detecting the status (mainly, pressure or temperature) of refrigerant in the refrigerant circuit RC is disposed in the outdoor unit 10. The outdoor-side sensors are a pressure sensor and a temperature sensor, such as a thermistor and a thermocouple. Examples of the outdoor-side sensors include a suction pressure sensor that detects the pressure of refrigerant at a suction side of the compressor 11 (suction pressure), a discharge pressure sensor that detects the pressure of refrigerant at a discharge side of the compressor 11 (discharge pressure), a refrigerant temperature sensor that detects the temperature of refrigerant in the outdoor heat exchanger 14 (for example, the degree of subcooling SC), and an outside air temperature sensor that detects the temperature of outside air.

The outdoor unit 10 includes an outdoor unit control unit that controls the operations and statuses of the devices included in the outdoor unit 10. The outdoor unit control unit includes a microcomputer including a CPU, a memory, and the like. The outdoor unit control unit is electrically connected to the devices (11, 13, 16, 17, 18, 25, and the like), included in the outdoor unit 10, and the outdoor-side sensors 26, and inputs or outputs signals to or from each other. The outdoor unit control unit individually sends or receives control signals, or the like, to or from an indoor unit control unit (described later) or remote control unit (not shown) of each indoor unit 40 via a communication line.

a) Indoor Unit 40

The indoor units 40 are connected to the outdoor unit 10 via the liquid-side connection pipe La and the gas-side connection pipe Ga. Each indoor unit 40 is disposed in parallel or series with the other indoor units 40 with respect to the outdoor unit 10. In FIG. 1, the indoor unit 40*a* is disposed in series with the indoor unit 40*b*, or the like, and is disposed in parallel with the indoor units 40*c*, 40*d*, or the like. Each indoor unit 40 is placed in the associated object space SP. In FIG. 2, the indoor units 40*a*, 40*b* are installed in the object space SP1 (more specifically, a ceiling space SPa of the object space SP1), and the indoor units 40*c*, 40*d* are installed in the object space SP2 (more specifically, a ceiling space SPa of the object space SP1) located on the floor below the object space SP1. For this reason, in one or more embodiments, the installation level of each of the indoor units 40*c*, 40*d* is lower than the installation level of each of the indoor units 40*a*, 40*b*. In other words, each of the indoor units 40*a*, 40*b* corresponds to the "first indoor unit" in the claims, and each of the indoor units 40*c*, 40*d* corresponds to the "second indoor unit" in the claims.

Each indoor unit 40 makes up part of the refrigerant circuit RC (indoor-side circuit RC2). Each indoor unit 40 mainly includes a plurality of refrigerant pipes (a thirteenth pipe P13, a fourteenth pipe P14), an indoor expansion valve 41, and the indoor heat exchanger 42, as devices that make up the indoor-side circuit RC2.

The thirteenth pipe P13 connects the liquid-side connection pipe La and a liquid-side refrigerant inlet/outlet port of the indoor heat exchanger 42. The fourteenth pipe P14 connects a gas-side refrigerant inlet/outlet port of the indoor heat exchanger 42 and the gas-side connection pipe Ga. These refrigerant pipes (P13, P14) each may be actually made up of a single pipe or may be made up of a plurality of pipes connected via a joint, or the like.

The indoor expansion valve 41 is an electronic expansion valve of which the opening degree is controllable. The indoor expansion valve 41 decompresses inflow refrigerant or adjusts the flow rate according to the opening degree. The indoor expansion valve 41 is disposed in the thirteenth pipe P13 and is located between the liquid-side connection pipe La and the indoor heat exchanger 42. The indoor expansion valve 41, during normal cycle operation, decompresses refrigerant flowing from the liquid-side connection pipe La into the indoor unit 40.

The indoor heat exchanger 42 is a heat exchanger that functions as an evaporator (or heater) or condenser (or radiator) for refrigerant. The indoor heat exchanger 42, during normal cycle operation, functions as the evaporator for refrigerant. The indoor heat exchanger 42, during reverse cycle operation, functions as the condenser for refrigerant. The indoor heat exchanger 42 includes a plurality of heat transfer tubes and heat transfer fins (not shown). The indoor heat exchanger 42 is configured such that heat is exchanged between refrigerant in the heat transfer tubes and air (indoor-side air flow (described later)) passing around the heat transfer tubes or the heat transfer fins.

The indoor unit 40 includes an indoor fan 45 for taking in air in the object space SP, allowing the air to pass through the indoor heat exchanger 42 to exchange heat with refrigerant, and then sending the air to the object space SP again. The indoor fan 45 includes an indoor fan motor (not shown) that is a drive source. The indoor fan 45, while being driven, generates indoor air flow as a heating source or cooling source for refrigerant flowing through the indoor heat exchanger 42.

Indoor-side sensors (not shown) for detecting the status (mainly, pressure or temperature) of refrigerant in the refrigerant circuit RC are disposed in the indoor unit 40. The indoor-side sensors are a pressure sensor and a temperature sensor, such as a thermistor and a thermocouple. Examples of the indoor-side sensors include a temperature sensor that detects the temperature of refrigerant in the indoor heat exchanger 42 (for example, the degree of superheating) and a pressure sensor that detects the pressure of refrigerant.

The indoor unit 40 includes an indoor unit control unit that controls the operations and statuses of the devices included in the indoor unit 40. The indoor unit control unit includes a microcomputer including a CPU, a memory, and the like. The indoor unit control unit is electrically connected to the devices (41, 45) included in the indoor unit 40 and the indoor-side sensors, and inputs or outputs signals to or from each other. The indoor unit control unit is connected to the outdoor unit control unit and the remote control unit (not shown) via the communication line. The indoor unit control unit sends or receives control signals, or the like, to or from the outdoor unit control unit or the remote control unit.

a) Liquid-Side Connection Pipe La, Gas-Side Connection Pipe Ga

The liquid-side connection pipe La and the gas-side connection pipe Ga are connection pipes that connect the outdoor unit 10 and the indoor units 40, and are installed on site. The pipe length and pipe diameter of each of the liquid-side connection pipe La and the gas-side connection pipe Ga are selected as needed according to design specifications and an installation environment.

The liquid-side connection pipe La is a pipe that makes up the liquid-side connection circuit RC3 (liquid-side connection circuit RC3*a*) between the outdoor unit 10 and the indoor units 40. The liquid-side connection pipe La is made up of a plurality of pipes, joints, and the like, connected. Specifically, the liquid-side connection pipe La includes a plurality of connection pipes (a first liquid-side connection pipe L1, a second liquid-side connection pipe L2, a third liquid-side connection pipe L3, a fourth liquid-side connection pipe L4, a fifth liquid-side connection pipe L5, . . . ), a plurality of branch parts BP (hereinafter, referred to as "liquid-side branch parts BPa"), and the like. The connection pipes (L1, L2, L3, L4, L5, . . . ) included in the liquid-side connection pipe La each may be actually made up of a single pipe or may be made up of a plurality of pipes connected via a joint, or the like.

One end of the first liquid-side connection pipe L1 is connected to the liquid-side stop valve 19 of the outdoor unit 10. The first liquid-side connection pipe L1 is disposed on the outdoor unit 10 side with respect to the other connection pipes (L2, L3, L4, L5, . . . ) in the liquid-side connection circuit RC3*a*. The first liquid-side connection pipe L1, the second liquid-side connection pipe L2, and the third liquid-side connection pipe L3 are connected at the liquid-side branch part BPa located on the most outdoor unit 10 side in the liquid-side connection circuit RC3*a*, and communicate with one another.

The other connection pipes (L2, L3, L4, L5, . . . ) included in the liquid-side connection pipe La form refrigerant passages between the first liquid-side connection pipe L1 and the associated indoor units 40. In one or more embodiments, the second liquid-side connection pipe L2 is associated with the indoor units 40*a*, 40*b*, or the like, and the third liquid-side connection pipe L3 and the fourth liquid-side connection pipe L4 are associated with the indoor units 40*c*, 40*d*, or the like. The fifth liquid-side connection pipe L5 is associated with the other indoor units 40, or the like.

One end side of each of the second liquid-side connection pipe L2 and the third liquid-side connection pipe L3 communicates with the other end side of the first liquid-side connection pipe L1 via the branch part BP. The second liquid-side connection pipe L2 and the third liquid-side connection pipe L3 are disposed in parallel with each other with respect to the first liquid-side connection pipe L1.

One end side of each of the fourth liquid-side connection pipe L4 and the fifth liquid-side connection pipe L5 communicates with the other end side of the third liquid-side connection pipe L3 via the branch part BP. The fourth liquid-side connection pipe L4 and the fifth liquid-side connection pipe L5 are disposed in parallel with each other with respect to the third liquid-side connection pipe L3.

The gas-side connection pipe Ga is a pipe that makes up a gas-side connection circuit RC3 (gas-side connection circuit RC3*b*) between the outdoor unit 10 and the indoor units 40 and through which, during operation, low-pressure refrigerant flows. The gas-side connection pipe Ga is made up of a plurality of pipes, joints, and the like, connected. The gas-side connection pipe Ga includes a plurality of connection pipes (a first gas-side connection pipe G1, a second gas-side connection pipe G2, a third gas-side connection pipe G3, a fourth gas-side connection pipe G4, and a fifth gas-side connection pipe G5), a plurality of branch parts BP (hereinafter, referred to as "gas-side branch parts BPb"), and the like. The connection pipes (G1, G2, G3, G4, G5, . . . ) included in the gas-side connection pipe Ga each may be actually made up of a single pipe or may be made up of a plurality of pipes connected via a joint, or the like.

One end of the first gas-side connection pipe G1 is connected to the gas-side stop valve 20 of the outdoor unit 10. The first gas-side connection pipe G1 is disposed on the outdoor unit 10 side with respect to the other connection pipes (G2, G3, G4, G5, . . . ) in the gas-side connection circuit RC3*b*. The first gas-side connection pipe G1, the second gas-side connection pipe G2, and the third gas-side connection pipe G3 are connected at the gas-side branch part BPb located on the most outdoor unit 10 side in the gas-side connection circuit RC3*b*, and communicate with one another.

The other connection pipes (G2, G3, G4, G5, . . . ) included in the gas-side connection pipe Ga form refrigerant passages between the first gas-side connection pipe G1 and the associated indoor units 40. In one or more embodiments, the second gas-side connection pipe G2 is associated with the indoor units 40*a*, 40*b*, or the like, and the third gas-side connection pipe G3 and the fourth gas-side connection pipe G4 are associated with the indoor units 40*c*, 40*d*, or the like. The fifth gas-side connection pipe G5 is associated with the other indoor units 40, or the like.

One end side of each of the second gas-side connection pipe G2 and the third gas-side connection pipe G3 communicates with the other end side of the first gas-side connection pipe G1 via the branch part BP. The second gas-side connection pipe G2 and the third gas-side connection pipe G3 are disposed in parallel with each other with respect to the first gas-side connection pipe G1.

One end side of each of the fourth gas-side connection pipe G4 and the fifth gas-side connection pipe G5 communicates with the other end side of the third gas-side connection pipe G3 via the branch part BP. The fourth gas-side connection pipe G4 and the fifth gas-side connection pipe G5 are disposed in parallel with each other with respect to the third gas-side connection pipe G3.

In one or more embodiments, as shown in FIG. 2, the second liquid-side connection pipe L2 and the second gas-side connection pipe G2 are mainly disposed in the ceiling space SPa of the object space SP1 so as to extend along the horizontal direction. As shown in FIG. 2, the fourth liquid-side connection pipe L4 and the fourth gas-side connection pipe G4 are mainly disposed in the ceiling space SPa of the object space SP2 located on the floor below the object space SP1 so as to extend along the right-left direction (horizontal direction). In other words, in one or more embodiments, the installation level of each of the fourth liquid-side connection pipe L4 and the fourth gas-side connection pipe G4 is lower than the installation level of each of the second liquid-side connection pipe L2 and the second gas-side connection pipe G2. As shown in FIG. 2, the third liquid-side connection pipe L3 and the third gas-side connection pipe G3 are mainly disposed in a space between an outer wall of the building B1 and an inner wall of the object space SP so as to extend along the up-down direction (vertical direction).

In the following description, one or both of the liquid-side connection pipe La and the gas-side connection pipe Ga are referred to as "connection pipe". In the connection circuit RC3, of the connection pipes connected at the branch parts BP, the connection pipes located on the outdoor unit 10 side (for example, L1 for L2 and L3 or L3 for L4 and L5) are referred to as "outdoor unit-side connection pipes CP1", and any one or some or all of the connection pipes communicating with the outdoor unit-side connection pipe CP1 (for example, L2 and L3 for L1 or L4 and L5 for L3) are referred to as "indoor unit-side connection pipes CP2".

The branch parts BP (the liquid-side branch part BPa and the gas-side branch part BPb) included in the connection pipe each are a part that diverges refrigerant flowing from the outdoor unit 10 side (that is, the outdoor unit-side connection pipe CP1 side) to the indoor unit-side connection pipes CP2 and a part that merges refrigerant flowing from the indoor unit-side connection pipes CP2 side.

In the air-conditioning system 100, each branch part BP is made up of a branch pipe unit 50 (a first branch pipe unit 51 or a second branch pipe unit 60). The details of each branch pipe unit 50 will be described later.

(2) Flow of Refrigerant in Refrigerant Circuit RC

Hereinafter, the flow of refrigerant in the refrigerant circuit RC will be described. In the air-conditioning system 100, mainly, the normal cycle operation, such as cooling operation, and the reverse cycle operation, such as heating operation, take place. Here, a low pressure in the refrigeration cycle is the pressure of refrigerant that is taken into the compressor 11, and a high pressure in the refrigeration cycle is the pressure of refrigerant that is discharged from the compressor 11.

(2-1) Flow of Refrigerant During Normal Cycle Operation

Figure 3:
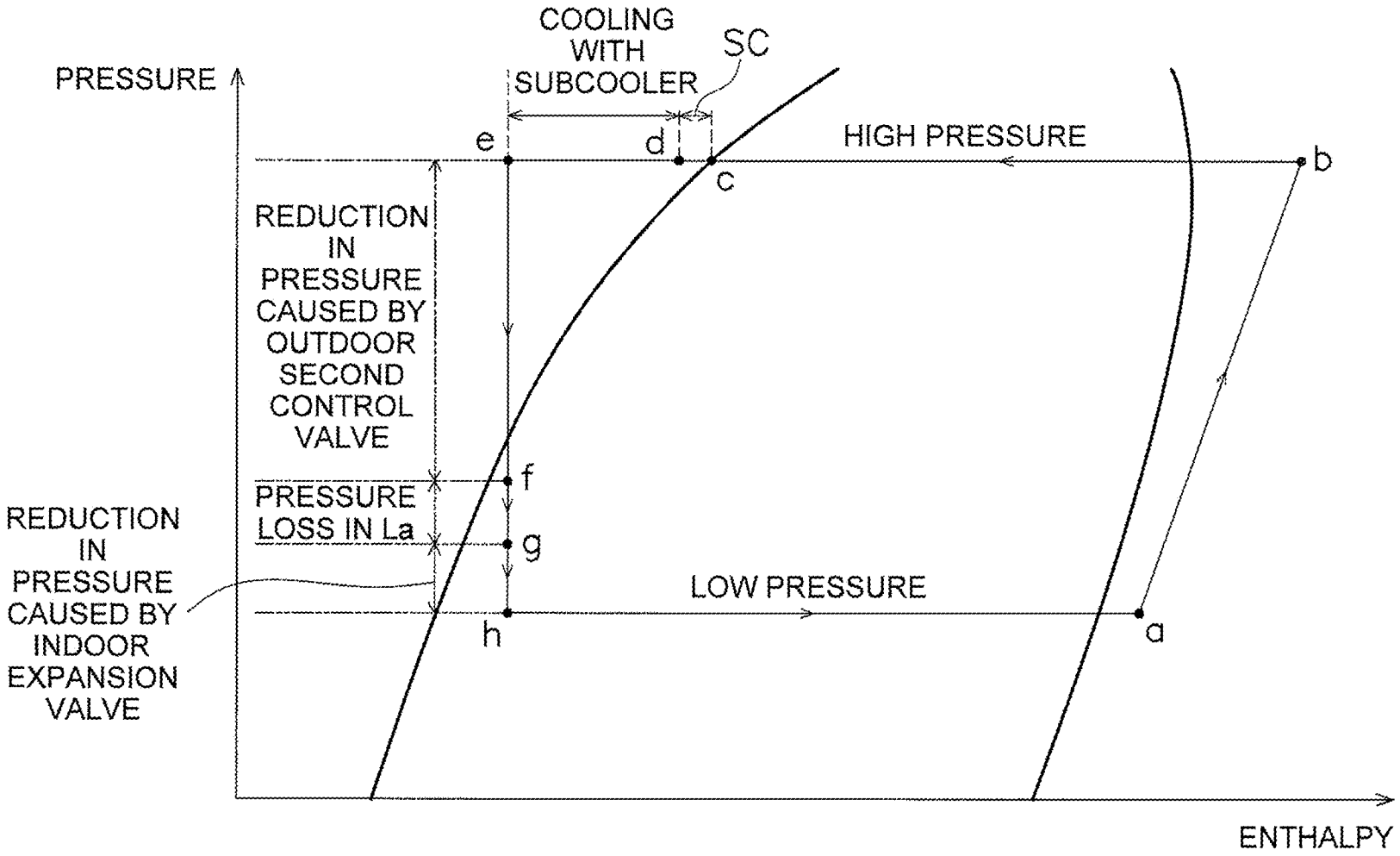
FIG. 3 is a schematic view that shows an example of a refrigeration cycle during normal cycle operation (during normal control).

FIG. 3 is a schematic view that shows an example of the refrigeration cycle during normal cycle operation (during normal control). During normal cycle operation, the four-way valve 13 is controlled to a normal cycle mode, and refrigerant filled in the refrigerant circuit RC mainly circulates in order of the outdoor-side circuit RC1 (the compressor 11, the outdoor heat exchanger 14, the outdoor first control valve 16, the main passage 151 of the subcooler 15, and the outdoor second control valve 17), the liquid-side connection circuit RC3*a*, the indoor-side circuit RC2 (the indoor expansion valve 41 and the indoor heat exchanger 42) of each indoor unit 40 in an operating state (operating indoor unit), and the compressor 11.

During normal cycle operation, part of refrigerant flowing through the sixth pipe P6 branches into the ninth pipe P9, passes through the outdoor third control valve 18 and the subcooler 15 (sub-passage 152), and is then returned to the outdoor-side circuit RC1 (compressor 11) via the gas-side connection circuit RC3*b*.

Specifically, as the normal cycle operation is started, refrigerant is taken into the compressor 11, compressed to a high pressure of the refrigeration cycle, and then discharged (see a to b in FIG. 3) in the outdoor-side circuit RC1. In the compressor 11, displacement control commensurate with a thermal load that is required from the operating indoor unit(s) is performed. Specifically, a target value of suction pressure (see a in FIG. 3) is set according to a thermal load that is required from the indoor unit(s) 40, and the operation frequency of the compressor 11 is controlled such that the suction pressure becomes the target value. Gas refrigerant discharged from the compressor 11 flows into the gas-side outlet/inlet port of the outdoor heat exchanger 14.

Gas refrigerant flowing into the outdoor heat exchanger 14 exchanges heat with outdoor air flow that is sent by the outdoor fan 25, radiates heat, and condenses in the outdoor heat exchanger 14 (see b to d in FIG. 3). At this time, refrigerant becomes liquid refrigerant in a subcooled state with a degree of subcooling SC (see c to d in FIG. 3). Refrigerant flowing out from the liquid-side outlet/inlet port of the outdoor heat exchanger 14 branches in process of flowing through the sixth pipe P6.

One part of refrigerant having branched in process of flowing through the sixth pipe P6 passes through the outdoor first control valve 16 and flows into the main passage 151 of the subcooler 15. Refrigerant flowing into the main passage 151 of the subcooler 15 exchanges heat with refrigerant flowing through the sub-passage 152 to be cooled and further enters a state with a degree of subcooling (see d to e in FIG. 3).

Liquid refrigerant flowing out from the main passage 151 of the subcooler 15 undergoes decompression or adjustment of the flow rate according to the opening degree of the outdoor second control valve 17, enters a gas-liquid two-phase state, and becomes intermediate-pressure refrigerant lower in pressure than high-pressure refrigerant and higher in pressure than low-pressure refrigerant (see e to f in FIG. 3). Thus, during normal cycle operation, refrigerant in a gas-liquid two-phase state is transferred to the liquid-side connection circuit RC3*a* (liquid-side connection pipe La), and gas-liquid two-phase transfer is realized for refrigerant that is transferred from the outdoor unit 10 side to the indoor units 40 side. In other words, the outdoor second control valve 17, during normal cycle operation, decompresses refrigerant such that refrigerant flowing from the outdoor unit 10 to the indoor units 40 passes the liquid-side connection pipe La in a gas-liquid two-phase state. In relation to this, as compared to the case of liquid transfer that refrigerant flowing through the liquid-side connection pipe La is in a liquid state, the liquid-side connection pipe La is not filled with refrigerant in a liquid state, and the amount of refrigerant present in the liquid-side connection pipe La can be reduced accordingly.

Gas-liquid two-phase refrigerant flowing out from the outdoor unit 10 passes through the liquid-side connection circuit RC3*a* and flows into the indoor-side circuit RC2 of each operating indoor unit. Refrigerant flowing through the liquid-side connection circuit RC3*a* decreases in pressure because of a pressure loss (see f to g in FIG. 3).

The other part of refrigerant having branched in process of flowing through the sixth pipe P6 in the outdoor-side circuit RC1 flows into the outdoor third control valve 18, undergoes decompression or adjustment of the flow rate according to the opening degree of the outdoor third control valve 18, and then flows into the sub-passage 152 of the subcooler 15. Refrigerant flowing into the sub-passage 152 of the subcooler 15 exchanges heat with refrigerant flowing through the main passage 151, passes through the twelfth pipe P12, and merges into refrigerant flowing through the first pipe P1.

Refrigerant flowing into the indoor-side circuit RC2 flows into the indoor expansion valve 41, undergoes decompression to a low pressure in the refrigeration cycle according to the opening degree of the indoor expansion valve 41 (see g to h in FIG. 3), and then flows into the indoor heat exchanger 42.

Refrigerant flowing into the indoor heat exchanger 42 exchanges heat with indoor air flow that is sent by the indoor fan 45 to evaporate into gas refrigerant (see h to a in FIG. 3). Gas refrigerant flowing out from the indoor heat exchanger 42 flows out from the indoor-side circuit RC2.

Refrigerant flowing out from the indoor-side circuit RC2 flows through the gas-side connection circuit RC3*b* and flows into the outdoor-side circuit RC1. Refrigerant flowing into the outdoor-side circuit RC1 flows through the first pipe P1, passes through the four-way valve 13 and the second pipe P2, and flows into the accumulator 12. Refrigerant flowing into the accumulator 12 is temporarily accumulated and then taken into the compressor 11 again.

(2-2) Flow of Refrigerant During Reverse Cycle Operation

During reverse cycle operation, the four-way valve 13 is controlled to a reverse cycle mode, and refrigerant filled in the refrigerant circuit RC mainly circulates in order of the outdoor-side circuit RC1 (compressor 11), the gas-side connection circuit RC3*b*, the indoor-side circuit RC2 (the indoor heat exchanger 42 and the indoor expansion valve 41) of each operating indoor unit, the liquid-side connection circuit RC3*a*, and the outdoor-side circuit RC1 (the outdoor second control valve 17, the subcooler 15, the outdoor first control valve 16, the outdoor heat exchanger 14, and the compressor 11).

Specifically, as the reverse cycle operation is started, refrigerant is taken into the compressor 11, compressed to a high pressure, and then discharged in the outdoor-side circuit RC1. In the compressor 11, displacement control commensurate with a thermal load that is required from the operating indoor unit(s) is performed. Gas refrigerant discharged from the compressor 11 flows out from the outdoor unit 10 through the fourth pipe P4 and the first pipe P1, and flows into the indoor-side circuit RC2 of each operating indoor unit 40 through the gas-side connection circuit RC3*b*.

Refrigerant flowing into the indoor-side circuit RC2 flows into the indoor heat exchanger 42, and exchanges heat with indoor air flow that is sent by the indoor fan 45 to condense. Refrigerant flowing out from the indoor heat exchanger 42 flows into the indoor expansion valve 41, and undergoes decompression to a low pressure in the refrigeration cycle according to the opening degree of the indoor expansion valve 41. Then, refrigerant flows out from the indoor-side circuit RC2.

Refrigerant flowing out from the indoor-side circuit RC2 flows into the outdoor-side circuit RC1 through the liquid-side connection circuit RC3*a*. Refrigerant flowing into the outdoor-side circuit RC1 passes through the ninth pipe P9, the outdoor second control valve 17, the eighth pipe P8, the subcooler 15 (main passage 151), the seventh pipe P7, the outdoor first control valve 16, and the sixth pipe P6 and flows into the liquid-side outlet/inlet port of the outdoor heat exchanger 14.

Refrigerant flowing into the outdoor heat exchanger 14 exchanges heat with outdoor air flow that is sent by the outdoor fan 25 to evaporate in the outdoor heat exchanger 14. After that, refrigerant flows out from the gas-side outlet/inlet port of the outdoor heat exchanger 14, passes through the fifth pipe P5, the four-way valve 13, and the second pipe P2, and flows into the accumulator 12. Refrigerant flowing into the accumulator 12 is temporarily accumulated and then taken into the compressor 11 again.

(3) Details of Branch Pipe Unit 50

Each branch pipe unit 50 is a unit for making up the branch part BP in the connection circuit RC3. Each branch pipe unit 50 is preassembled at a factory before installation on site, or the like, and connected to other pipes (here, the outdoor unit-side connection pipe CP1 and the indoor unit-side connection pipes CP2) on installation site.

Each branch pipe unit 50 disposed in the refrigerant circuit RC is any one of the first branch pipe unit 51 and the second branch pipe unit 60 having a function of providing a trap in the connection circuit RC3. In each branch part BP, an optimal one of the first branch pipe unit 51 and the second branch pipe unit 60 is selected.

(3-1) First Branch Pipe Unit 51

Figure 4:
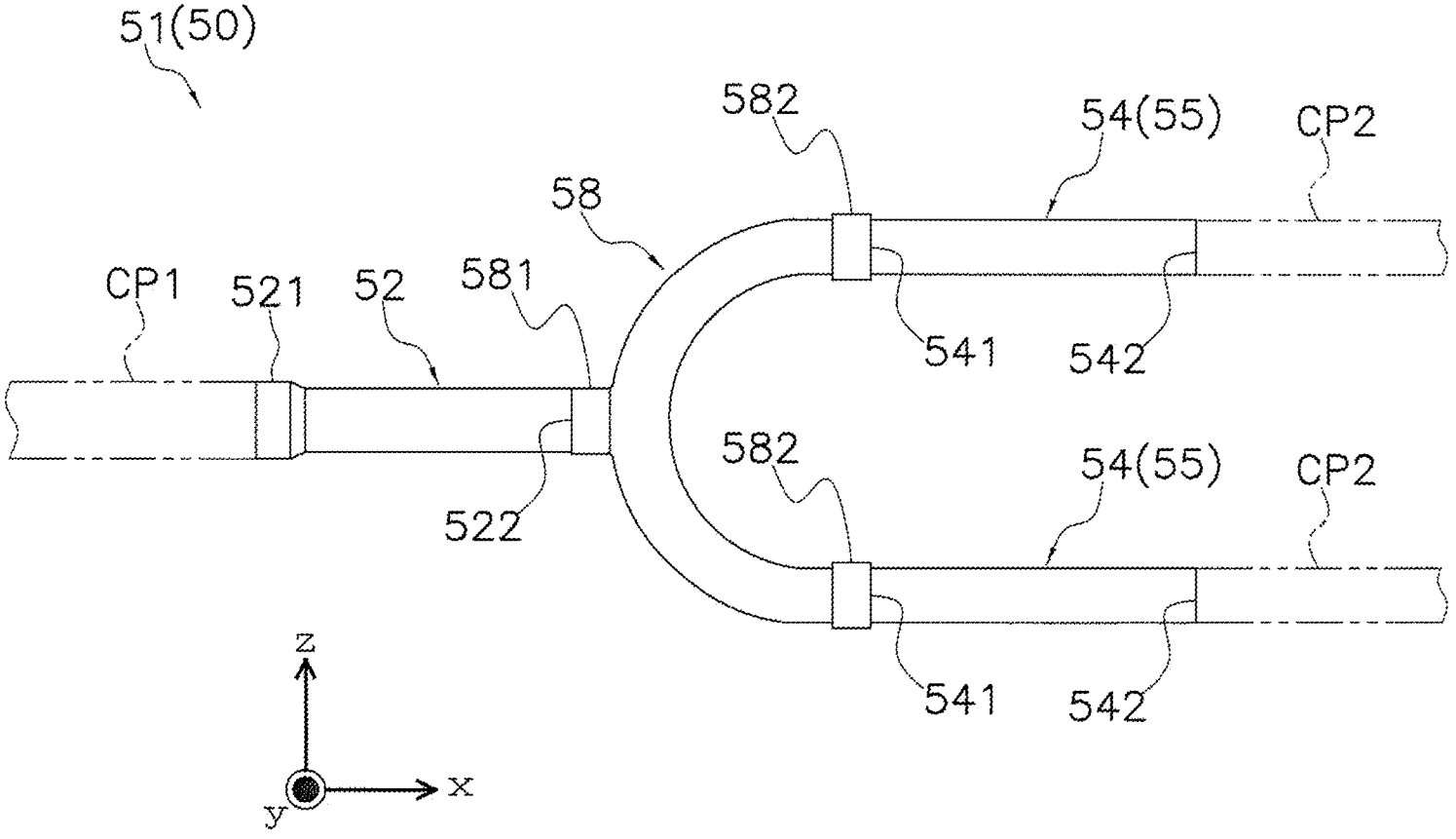
FIG. 4 is a schematic configuration diagram of a first branch pipe unit.

FIG. 4 is a schematic configuration diagram of the first branch pipe unit 51. In one or more embodiments, an x direction and a y direction are perpendicular to each other. Each first branch pipe unit 51 includes a main pipe 52, a branch pipe group 55 made up of a plurality of (here, two) branch pipes 54, and a connection pipe portion 58. In the first branch pipe unit 51, the main pipe 52 and each branch pipe 54 are connected via the connection pipe portion 58 and communicate with each other.

Figure 6:
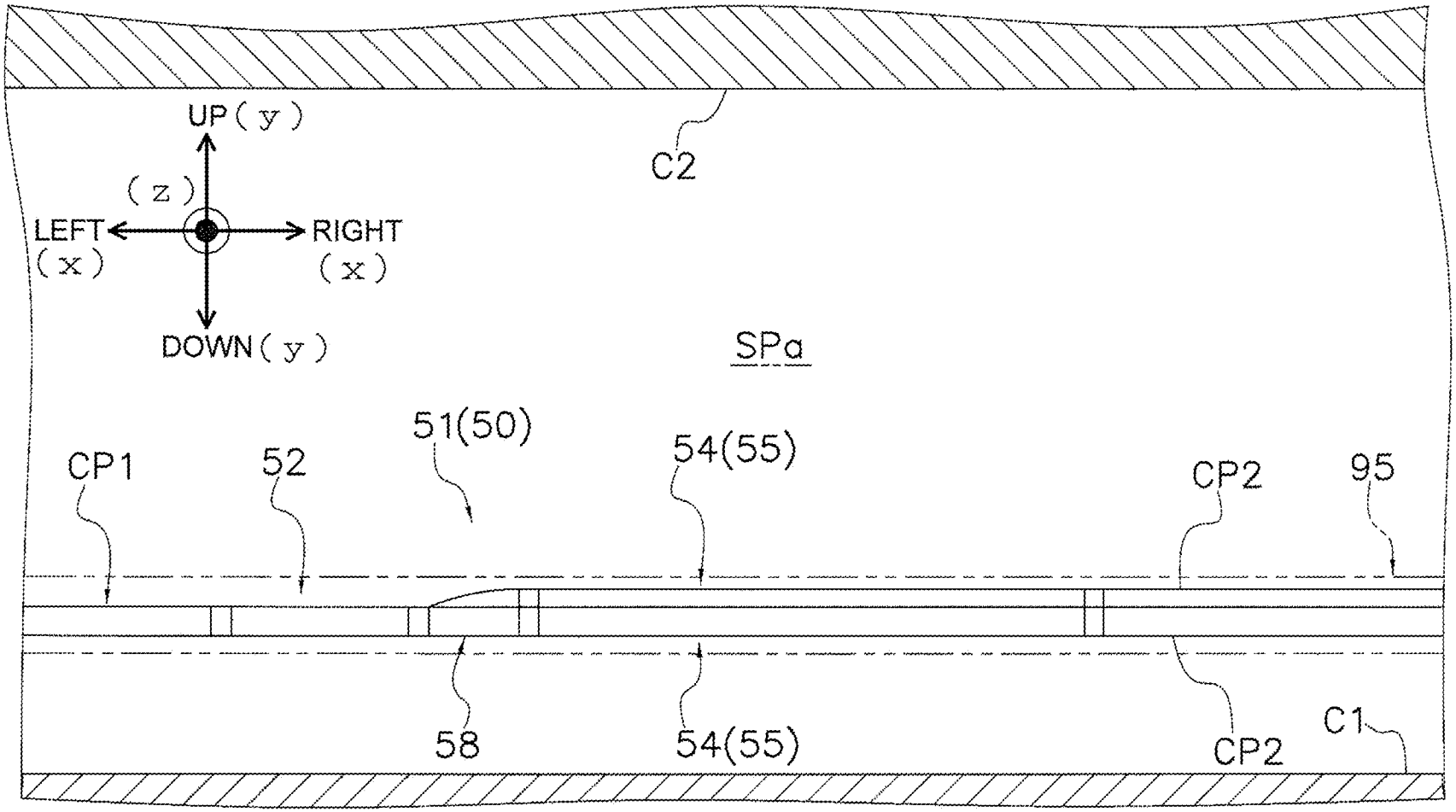
FIG. 6 is a schematic diagram that shows an example of an installation mode of the first branch pipe unit.

The main pipe 52 mainly extends along the x direction (see FIG. 4, FIG. 6, and the like). The main pipe 52 is located on the outdoor unit 10 side with respect to the connection pipe portion 58 in an installation state. The main pipe 52 is associated in a one-to-one correspondence with any one of the outdoor unit-side connection pipes CP1, and one end 521 is connected to the associated outdoor unit-side connection pipe CP1 in an installation state. The other end 522 of the main pipe 52 is connected to a first connection portion 581 of the connection pipe portion 58. The main pipe 52 forms a passage for refrigerant flowing to the connected branch pipes 54 or refrigerant flowing from the branch pipes 54.

Each branch pipe 54 mainly extends along the x direction (see FIG. 4, FIG. 6, and the like). Each branch pipe 54 is located on the associated indoor unit 40 side with respect to the connection pipe portion 58 in an installation state. One ends 541 of the branch pipes 54 are individually connected to second connection portions 582 of the connection pipe portion 58 in an installation state. Each branch pipe 54 is associated in a one-to-one correspondence with any one of the indoor unit-side connection pipes CP2, and the other end 542 is connected to the associated indoor unit-side connection pipe CP2.

The connection pipe portion 58 connects the main pipe 52 and the branch pipe group 55 (branch pipes 54) in the first branch pipe unit 51. In one or more embodiments, as shown in FIG. 4, the connection pipe portion 58 is curbed in substantially a U-shape or substantially a C-shape when viewed in the y direction. The connection pipe portion 58 has the first connection portion 581 that is connected to the main pipe 52. The connection pipe portion 58 has the plurality of (the same number as the number of the branch pipes 54 included in the first branch pipe unit 51; here, two) second connection portions 582 that are connected to the associated branch pipes 54. The connection pipe portion 58 has the first connection portion 581 at one end side, the other end side branches into two, and the second connection portion 582 is provided at each branched end portion.

(3-2) Second Branch Pipe Unit 60

Figure 5:
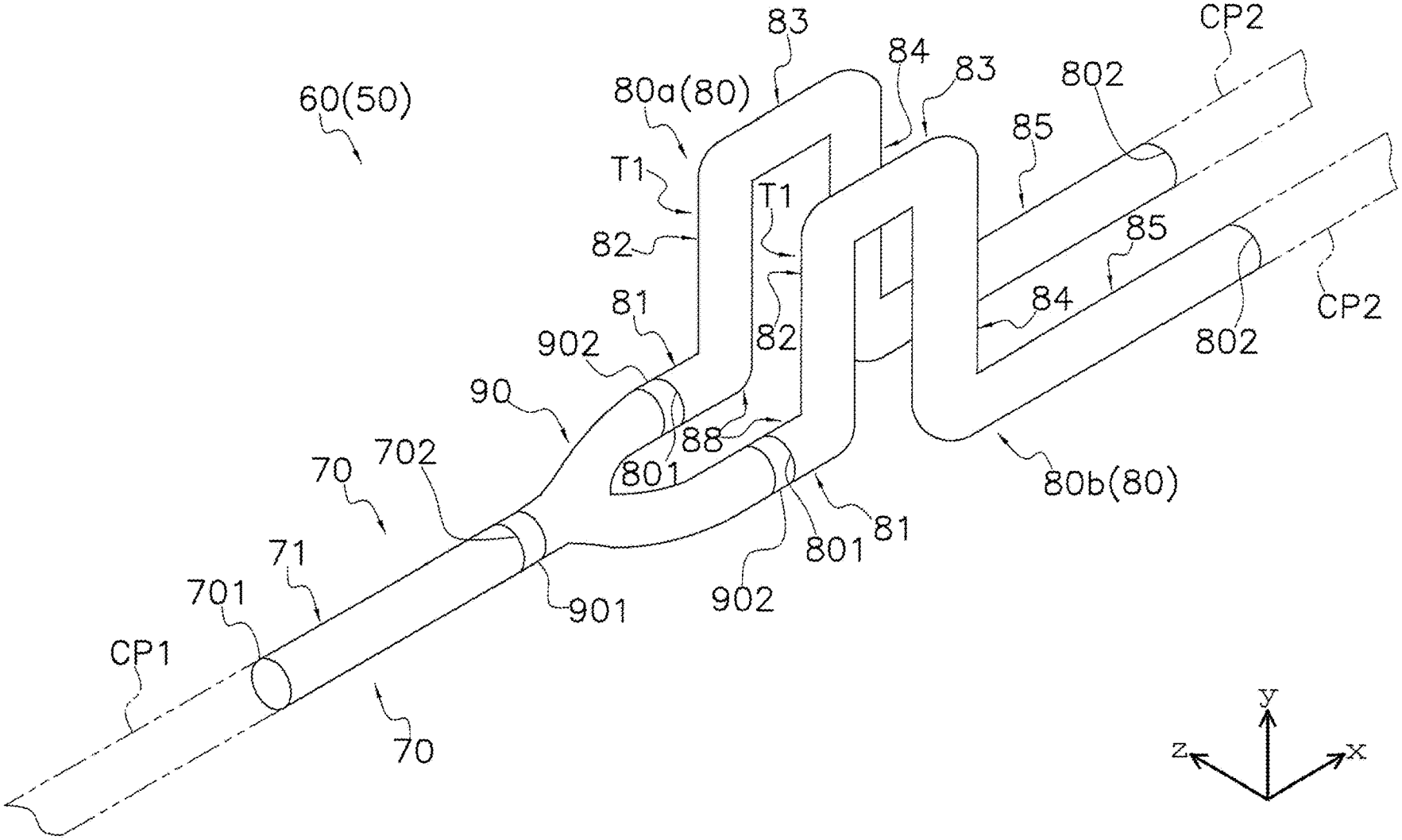
FIG. 5 is a schematic configuration diagram of a second branch pipe unit.

FIG. 5 is a schematic configuration diagram of the second branch pipe unit 60. In one or more embodiments, the x direction and the y direction are perpendicular to each other.

Each second branch pipe unit 60 includes a main pipe 70, a branch pipe group 88 made up of a plurality of (here, two) branch pipes 80, and a connection pipe portion 90. In the second branch pipe unit 60, the main pipe 70 and each branch pipe 80 are connected via the connection pipe portion 90 and communicate with each other.

The main pipe 70 (which corresponds to the "outdoor-side pipe" in the claims) is a pipe that sends refrigerant flowing from the outdoor unit-side connection pipe CP1 to the connection pipe portion 90 or a pipe that sends refrigerant flowing from the connection pipe portion 90 to the outdoor unit-side connection pipe CP1. The main pipe 70 is located on the outdoor unit 10 side with respect to the connection pipe portion 90 in an installation state. The main pipe 70 is associated in a one-to-one correspondence with any one of the outdoor unit-side connection pipes CP1. The main pipe 70 has a first main pipe portion 71 that mainly extends along the x direction (see FIG. 5, FIG. 7, and the like). In one or more embodiments, a terminal of the first main pipe portion 71 is one end 701 of the main pipe 70, and the distal end of the first main pipe portion 71 is the other end 702 of the main pipe 70. The terminal (701) of the main pipe 70 is connected to the associated outdoor unit-side connection pipe CP1 in an installation state. The distal end (702) of the main pipe 70 is connected to the first connection portion 901 of the connection pipe portion 90. The main pipe 70 forms a passage for refrigerant flowing to the connected branch pipes 80 or refrigerant flowing from the branch pipes 80. In one or more embodiments, the mode of configuration of the main pipe 70 is substantially the same as the main pipe 52 of the first branch pipe unit 51.

In one or more embodiments, the branch pipe group 88 includes two branch pipes 80 (80*a*, 80*b*). Each branch pipe 80 (which corresponds to the "indoor-side pipe" in the claims) is located on the associated indoor unit 40 side with respect to the connection pipe portion 90 in an installation state. One ends 801 of the branch pipes 80 are individually connected to the second connection portions 902 of the connection pipe portion 90 in an installation state. Each branch pipe 80 is associated in a one-to-one correspondence with any one of the indoor unit-side connection pipes CP2, and the other end 802 is connected to the associated indoor unit-side connection pipe CP2.

The size of each branch pipe 80 is selected as needed according to an installation environment and design specifications. In one or more embodiments, the size of each branch pipe 80 is a size suitable in providing the liquid-side connection circuit RC3*a* (specifically, the size is set to greater than or equal to two eighths to less than or equal to six eighths). Here, "two eighths" and "six eighths" are conventionally used names of pipe size. Specifically, "two eighths" here is ¼ inches, the outside diameter is 6.35 mm (or a value approximate to this), and the inside diameter is 4.75 mm (or a value approximate to this). "Six eighths" here is ¾ inches, the outside diameter is 19.05 mm (or a value approximate to this), and the inside diameter is 16.95 mm (or a value approximate to this).

Each branch pipe 80 includes a portion extending along the x direction and a portion extending along the y direction that intersects with the x direction. Specifically, the branch pipe 80 includes a first extended portion 81, a second extended portion 82, a turnaround portion 83, a third extended portion 84, and a fourth extended portion 85. In one or more embodiments, the portions (81 to 85) of the branch pipe 80 continuously extend in order of the first extended portion 81, the second extended portion 82, the turnaround portion 83, the third extended portion 84, and the fourth extended portion 85, and are integrated.

The first extended portion 81 is a portion that mainly extends along the x direction (that is, the extending direction of the main pipe 70). The first extended portion 81 is located on the main pipe 70 side with respect to the other portions (the second extended portion 82 to the fourth extended portion 85) in the branch pipe 80. In other words, the first extended portion 81 is located on the outdoor unit 10 side with respect to the other portions (the second extended portion 82, the turnaround portion 83, the third extended portion 84, and the fourth extended portion 85) of the branch pipe 80 in the connection circuit RC3 in an installation state. In one or more embodiments, one end of the first extended portion 81 corresponds to one end 801 of the branch pipe 80, and is connected to the second connection portion 902 of the connection pipe portion 90 in an installation state. The other end of the first extended portion 81 is connected to the second extended portion 82. The first extended portion 81 sends inflow refrigerant from one of the connection pipe portion 90 and the second extended portion 82 to the other in an installation state.

The second extended portion 82 mainly extends along the y direction (that is, the direction that intersects with the extending direction of the main pipe 70). In one or more embodiments, the second extended portion 82 extends at right angles with respect to the extending direction of each of the first extended portion 81 and the main pipe 70. The second extended portion 82 extends between the first extended portion 81 and the turnaround portion 83. The second extended portion 82 is located on the main pipe 70 side with respect to the turnaround portion 83, the third extended portion 84, and the fourth extended portion 85. In other words, the second extended portion 82 is located on the indoor unit 40 side with respect to the first extended portion 81 in the connection circuit RC3 in an installation state and is located on the outdoor unit 10 side with respect to the turnaround portion 83, the third extended portion 84, and the fourth extended portion 85. One end of the second extended portion 82 is connected to the first extended portion 81. The other end of the second extended portion 82 is connected to the turnaround portion 83. The second extended portion 82 sends inflow refrigerant from one of the first extended portion 81 and the turnaround portion 83 to the other in an installation state.

The turnaround portion 83 is a portion that mainly extends along the y direction (a direction in which the second extended portion 82 extends), bends, extends along the x direction, further bends, and extends along the y direction (a direction in which the third extended portion 84 extends). The turnaround portion 83 is a portion that extends between the second extended portion 82 and the turnaround portion 83 to connect both. The turnaround portion 83 is located on the main pipe 70 side with respect to the third extended portion 84 and the fourth extended portion 85. In other words, the turnaround portion 83 is located between the second extended portion 82 and the third extended portion 84, located on the indoor unit 40 side with respect to the first extended portion 81 and the second extended portion 82, and located on the outdoor unit 10 side with respect to the third extended portion 84 and the fourth extended portion 85 in the connection circuit RC3 in an installation state. One end of the turnaround portion 83 is connected to the other end of the second extended portion 82. The other end of the turnaround portion 83 is connected to the third extended portion 84. The turnaround portion 83 provides a refrigerant passage that turns inflow refrigerant around from one of the second extended portion 82 and the third extended portion 84 to the other in an installation state. The turnaround portion 83 is shown in the drawing so as to have a portion extending linearly in the x direction; however, the turnaround portion 83 may be made from a pipe bent into a U-shape. The configuration of such a U-shaped pipe can reduce the influence of pressure loss of refrigerant.

The third extended portion 84 is a portion that mainly extends along the y direction (that is, the direction that intersects with the extending direction of the main pipe 70). The extending direction of the third extended portion 84 is a direction opposite from the extending direction of the second extended portion 82. The third extended portion 84 is a portion that extends between the turnaround portion 83 and the fourth extended portion 85 to connect both. The third extended portion 84 is located on the main pipe 70 side with respect to the fourth extended portion 85. In other words, the third extended portion 84 is located on the indoor unit 40 side with respect to the first extended portion 81, the second extended portion 82, and the turnaround portion 83 and located on the outdoor unit 10 side with respect to the fourth extended portion 85 in the connection circuit RC3 in an installation state. One end of the third extended portion 84 is connected to the other end of the turnaround portion 83. The other end of the third extended portion 84 is connected to the fourth extended portion 85. The third extended portion 84 sends inflow refrigerant from one of the turnaround portion 83 and the fourth extended portion 85 to the other in an installation state.

The fourth extended portion 85 is a portion that mainly extends along the x direction (that is, the extending direction of the main pipe 70). The fourth extended portion 85 extends at right angles with respect to the extending direction of the third extended portion 84. The extending direction of the fourth extended portion 85 is the same as the extending direction of the first extended portion 81. The fourth extended portion 85 is a portion that extends between the third extended portion 84 and the indoor unit-side connection pipe CP2 to connect both in an installation state. The fourth extended portion 85 is located on the indoor unit 40 side with respect to the first extended portion 81, the second extended portion 82, the turnaround portion 83, and the third extended portion 84 in the connection circuit RC3 in an installation state. One end of the fourth extended portion 85 is connected to the other end of the third extended portion 84. The other end of the fourth extended portion 85 corresponds to the other end 802 of the branch pipe 80 and is connected to the associated indoor unit-side connection pipe CP2 in an installation state. The fourth extended portion 85 sends inflow refrigerant from one of the third extended portion 84 and the indoor unit-side connection pipe CP2 to the other in an installation state.

The connection pipe portion 90 (which corresponds to the "connection pipe" in the claims) connects the main pipe 70 and the branch pipe group 88 (branch pipes 80) in the second branch pipe unit 60. In one or more embodiments, as shown in FIG. 5, the connection pipe portion 90 is curbed in substantially a U-shape or substantially a C-shape when viewed in the y direction. The connection pipe portion 90 has the first connection portion 901 that is connected to the main pipe 70. The connection pipe portion 90 has the plurality of (the same number as the number of the branch pipes 80 included in the second branch pipe unit 60; here, two) second connection portions 902 that are connected to the associated branch pipes 80. The connection pipe portion 90 has the first connection portion 901 at one end side, the other end side branches into two, and the second connection portion 902 is provided at each branched end portion. In one or more embodiments, the mode of configuration of the connection pipe portion 90 is substantially the same as that of the connection pipe portion 90 of the first branch pipe unit 51.

(3-3) Mode of Installation of Branch Pipe Unit 50

Figure 7:
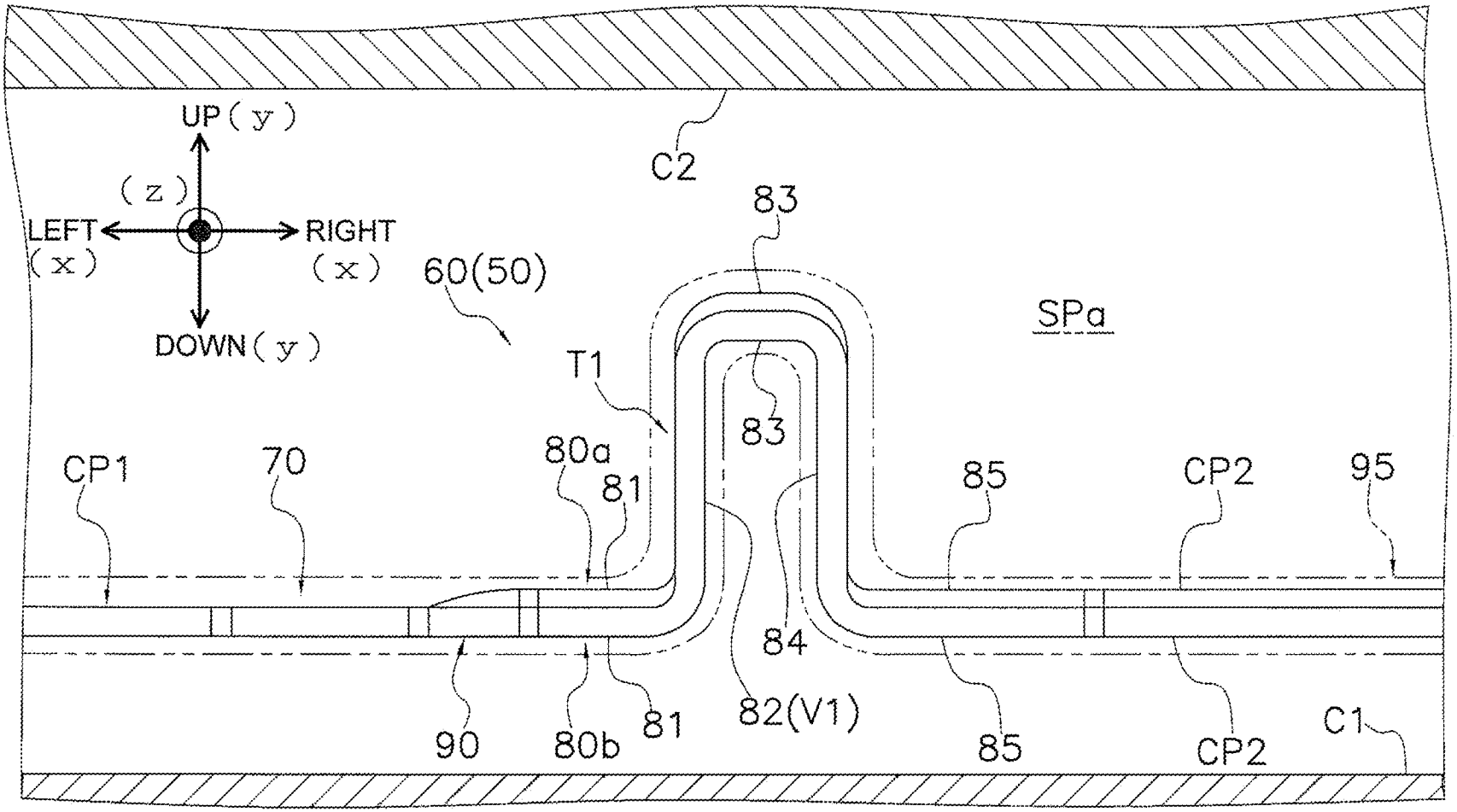
FIG. 7 is a schematic diagram that shows an example of an installation mode of the second branch pipe unit.

FIG. 6 is a schematic diagram that shows an example of the installation mode of the first branch pipe unit 51. FIG. 7 is a schematic diagram that shows an example of the installation mode of the second branch pipe unit 60. FIG. 6 and FIG. 7 show an example in which the branch pipe unit 50 is installed in the ceiling space SPa (a space above a ceiling, that is, the object space SP). In FIG. 6 and FIG. 7, the upper, lower, right, and left directions are indicated, a right-left direction corresponds to the x direction in FIG. 4 or FIG. 5, and an up-down direction corresponds to the y direction in FIG. 4 or FIG. 5. The right-left direction is included in the horizontal direction, and the up-down direction is included in the vertical direction. In other words, in one or more embodiments, in an installation state of the branch pipe unit 50, the x direction corresponds to the horizontal direction, and the y direction corresponds to the vertical direction. In FIG. 6 and FIG. 7, a front-rear direction perpendicular to the right-left direction corresponds to the z direction in FIG. 4 or FIG. 5 and is included in the horizontal direction.

The branch pipe unit 50 is placed in the ceiling space SPa together with the outdoor unit-side connection pipe CP1 and the indoor unit-side connection pipes CP2. The ceiling space SPa is a narrow space formed between a top surface (ceiling space bottom surface C1) of the ceiling in the object space SP and a roof or floor upstairs (ceiling space top surface C2). The ceiling space SPa is a space of which the dimension in the horizontal direction is large and the dimension in the vertical direction is small.

In one or more embodiments, as shown in FIG. 6 and FIG. 7, the first branch pipe unit 51 and the second branch pipe unit 60 are placed in such a position that the branch pipes (54, 80) are arranged in the horizontal direction (here, the z direction that intersects with the extending direction x) and the extending direction of each branch pipe (54, 80) and the extending direction of the main pipe (52, 70) match each other (here, both extend away from each other but the extending directions of both are the horizontal direction). In relation to this, in the ceiling space SPa, the major extending direction (here, the right-left direction, that is, the horizontal direction) of each indoor unit-side connection pipe CP2 and the major extending direction (here, the right-left direction, that is, the horizontal direction) of the outdoor unit-side connection pipe CP1 are substantially the same. In other words, in the ceiling space SPa of which the distance in the vertical direction is short, the first branch pipe unit 51 and the second branch pipe unit 60 are placed in such a position that the major extending direction (here, the right-left direction, that is, the horizontal direction) of each indoor unit-side connection pipe CP2 and the major extending direction (here, the right-left direction, that is, the horizontal direction) of the outdoor unit-side connection pipe CP1 are substantially the same.

The outdoor unit-side connection pipe CP1 extends along the major extending direction (rightward direction in FIG. 6 and FIG. 7) of the indoor unit-side connection pipe CP2 and is joined with a connection portion (one end 521 or 701 of the main pipe) of the first branch pipe unit 51 or the second branch pipe unit 60. The outdoor unit-side connection pipe CP1, the indoor unit-side connection pipes CP2, the first branch pipe unit 51, and/or the second branch pipe unit 60 is hung from the top in the ceiling space SPa by attaching brackets (not shown) fixed to the ceiling space top surface C2. The outdoor unit-side connection pipe CP1, the indoor unit-side connection pipes CP2, the first branch pipe unit 51, and the second branch pipe unit 60 are covered with a heat insulating material 95 for preventing condensation.

In FIG. 6, the first branch pipe unit 51 is installed in the ceiling space SPa in such a position that the main pipe 52 and the branch pipes 54 extend along the right-left direction (that is, the horizontal direction).

In FIG. 7, the second branch pipe unit 60 is placed in the ceiling space SPa in such a position that the main pipe 70 and the first extended portions 81, turnaround portions 83, and fourth extended portions 85 of the branch pipes 80 extend along the right-left direction (that is, the horizontal direction) and the second extended portions 82 and third extended portions 84 of the branch pipes 80 extend along the up-down direction (that is, the vertical direction). Here, in the second branch pipe unit 60, in each branch pipe 80, the second extended portion 82 extends along the direction (here, the y direction) that intersects with (here, perpendicular to) the extending direction of the main pipe 70. As shown in FIG. 7, the second extended portion 82 is disposed in a position so as to extend along the upward direction. In other words, the second extended portion 82 is an "upright portion V1" (which corresponds to the "upward extended portion" in the claims) extending upward in an installation state.

The upright portion V1 (second extended portion 82) functions as a trap portion T1 together with any one or some or all of the other portions (81, 83 to 85) included in the branch pipe 80. The trap portion T1 is a portion that, during normal cycle operation, when the indoor unit 40 in an operating state (operating indoor unit) and the indoor unit 40 in an operation stop state (hereinafter, referred to as "stopped indoor unit") are mixedly present, suppresses the flow of refrigerant flowing from the connection pipe portion 90 to the stopped indoor unit side.

(4) Function of Second Branch Pipe Unit 60

Figure 8:
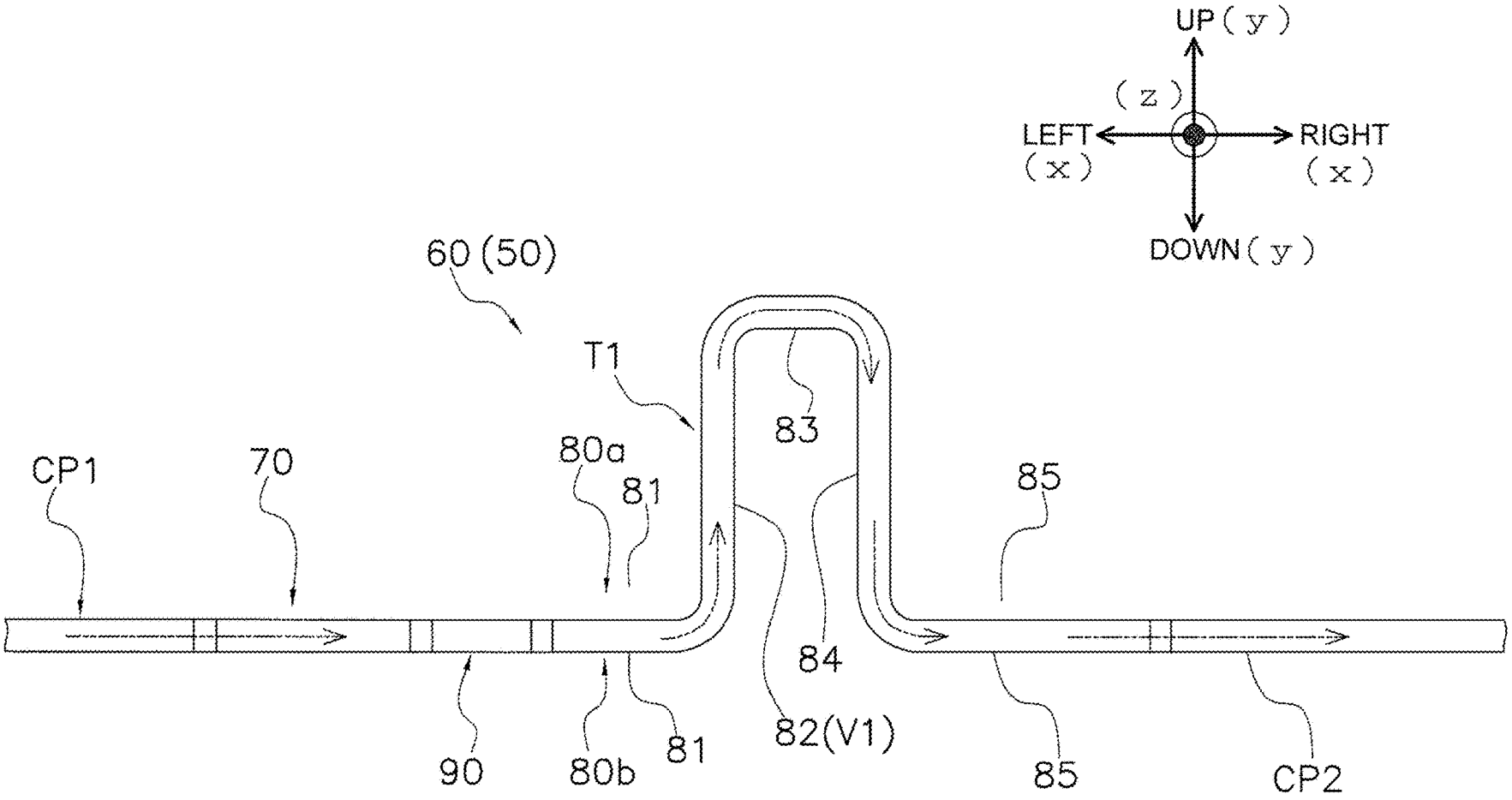
FIG. 8 is a schematic diagram that shows an example of the flow of refrigerant in the second branch pipe unit during normal cycle operation.

The second branch pipe unit 60 also functions as a "trap component" that makes up the trap portion T1. During normal cycle operation, refrigerant flows through the second branch pipe unit 60 in a mode as shown in FIG. 8. FIG. 8 is a schematic diagram that shows an example of the flow of refrigerant in the second branch pipe unit 60 during normal cycle operation. The alternate long and two-short dashed line arrows in FIG. 8 represent a direction in which refrigerant flows during normal cycle operation. In FIG. 8, only one branch pipe 80 of the branch pipe group 88 is depicted.

In the second branch pipe unit 60, during normal cycle operation, refrigerant in a gas-liquid two-phase state, flowing from the outdoor unit-side connection pipe CP1, flows into the main pipe 70. Refrigerant flowing into one end 701 of the main pipe 70 flows in the horizontal direction toward the other end 702 side (the indoor unit 40 side) and flows into the connection pipe portion 90. Refrigerant flowing into the first connection portion 901 of the connection pipe portion 90 diverges, flows to the second connection portions 902 side, and flows into the branch pipes 80. Refrigerant flowing into the branch pipe 80 communicating with the operating indoor unit flows from one end 801 side to the other end 802 side and then flows into the indoor unit-side connection pipe CP2. More specifically, refrigerant flowing along the horizontal direction in the first extended portion 81 flows into the second extended portion 82, flows along the upward direction, and flows into the turnaround portion 83. Refrigerant flowing into the turnaround portion 83 changes the flow direction, flows along the horizontal direction, changes the flow direction again, flows along the downward direction, and flows into the third extended portion 84. Refrigerant flowing into the third extended portion 84 flows along the downward direction and then flows into the fourth extended portion 85. Refrigerant flowing into the fourth extended portion 85 flows along the horizontal direction and flows into the indoor unit-side connection pipe CP2.

Figure 9:
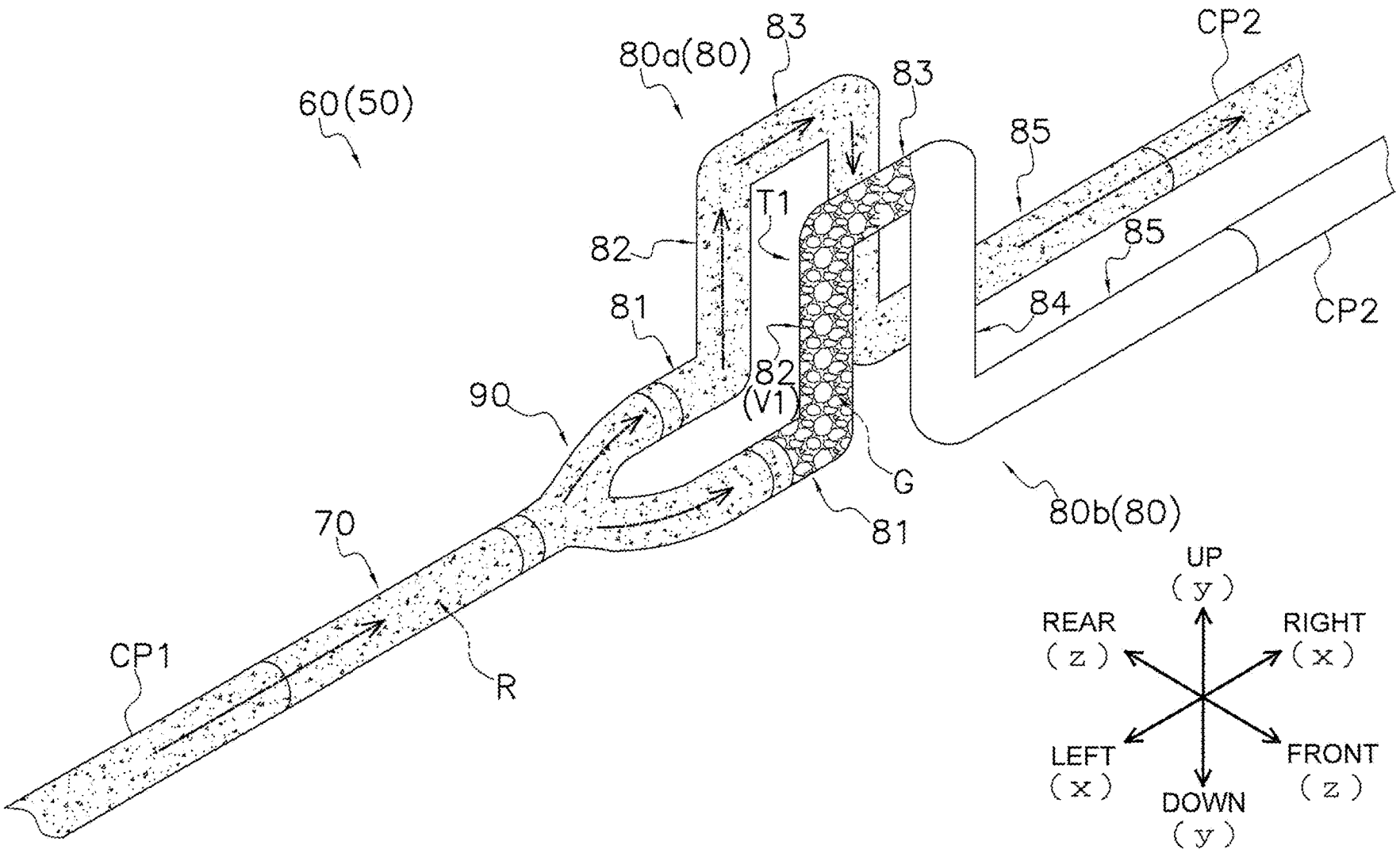
FIG. 9 is a schematic diagram that shows an example of the flow of refrigerant in the case where an operating indoor unit(s) and a stopped indoor unit(s) are mixedly present during normal cycle operation.

During normal cycle operation, when the operating indoor unit and the stopped indoor unit are mixedly present, refrigerant flows in a mode as shown in FIG. 9 in the second branch pipe unit 60. FIG. 9 is a schematic diagram that shows an example of the flow of refrigerant in the case where the operating indoor unit and the stopped indoor unit are mixedly present during normal cycle operation. In FIG. 9, reference sign "R" denotes refrigerant in a gas-liquid two-phase state, and reference sign "G" denotes gas refrigerant (gas accumulation) filled in the trap portion T1. The alternate long and two-short dashed line arrows in FIG. 9 represent a direction in which refrigerant flows during normal cycle operation.

During normal cycle operation, when the operating indoor unit and the stopped indoor unit are mixedly present, refrigerant in a gas-liquid two-phase state, flowing from the outdoor unit-side connection pipe CP1, flows into the main pipe 70. Refrigerant flowing into the main pipe 70 flows toward the indoor unit 40 side and flows into the connection pipe portion 90. Refrigerant flowing into the connection pipe portion 90 diverges and flows into the branch pipes 80. Refrigerant flowing into the branch pipe 80 communicating with the operating indoor unit (rear-side branch pipe 80*a* in FIG. 9) flows from one end 801 side to the other end 802 side and then flows into the indoor unit-side connection pipe CP2. On the other hand, in the branch pipe 80*b* communicating with the stopped indoor unit (the front-side branch pipe 80*b* in FIG. 9), the trap portion T1 (here, mainly, the upright portion V1) serves as a resistance, and the flow of refrigerant flowing into one end 801 of the branch pipe 80 attenuates. In relation to this, in the trap portion T1, a situation in which, of refrigerant in a gas-liquid two-phase state, gas refrigerant is filled (gas accumulation G) occurs. In other words, the trap portion T1 is filled with refrigerant in a gas state. Thus, the flow of refrigerant in a gas-liquid two-phase state, flowing into one end 801 of the branch pipe 80, toward the other end 802 side is suppressed. As a result, the flow of refrigerant toward the stopped indoor unit side is suppressed, so a shortage of the amount of circulating refrigerant in the operating indoor unit is avoided. In other words, a decrease in the performance of the operating indoor unit is minimized (5) With Regard to Installation Site of Second Branch Pipe Unit 60

During normal cycle operation, when the operating indoor unit and the stopped indoor unit are mixedly present, the second branch pipe unit 60 functions as a "trap component" that provides the trap portion T1. The trap portion T1 suppresses the flow of refrigerant in a gas-liquid two-phase state, flowing into one ends 801 of the branch pipes 80, to the other ends 802 side by being filled with refrigerant in a gas state. In the refrigerant circuit RC, the position of the branch part BP made up of the second branch pipe unit 60 is selected as needed according to design specifications or an installation environment. In other words, the second branch pipe unit 60 is disposed at such an effective position that, during normal cycle operation, when the operating indoor unit and the stopped indoor unit are mixedly present, a shortage of the amount of circulating refrigerant in the operating indoor unit is suppressed by suppressing the flow of refrigerant to the stopped indoor unit side according to an installation mode of the indoor units 40 included in the air-conditioning system 100, an installation level or branching mode of the connection pipes in the refrigerant circuit RC.

In one or more embodiments, the second branch pipe unit 60 is disposed at the liquid-side branch part BPa (the liquid-side branch part BL1 shown in FIG. 2) on the most outdoor unit 10 side (that is, the most upstream side during normal cycle operation). Specifically, in the liquid-side branch part BL1, the main pipe 70 is connected to the first liquid-side connection pipe L1, the first branch pipe 80*a* is connected to the second liquid-side connection pipe L2, and the second branch pipe 80*b* is connected to the third liquid-side connection pipe L3. Thus, for example, even when, of the indoor units 40 (specifically, 40*a*, 40*b*) installed in the object space SP1 and the indoor units 40 (specifically, 40*c*, 40*d*) installed in the object space SP2, one group is in an operating state in normal cycle operation and the other group is in an operation stop state, the flow of refrigerant to the stopped indoor units side is suppressed with the trap portions T1 of the branch pipes 80 communicating with the other group (stopped indoor units) in the liquid-side branch part BL1. In relation to this, a shortage of the amount of circulating refrigerant in the operating indoor units is suppressed, so a decrease in reliability is minimized.

In one or more embodiments, the first branch pipe 80*a* (see FIG. 9) located on the rear side in an installation state is connected to the second liquid-side connection pipe L2 (see FIG. 1 and FIG. 2) communicating with the indoor units 40*a*, 40*b*, and the like, installed in the object space SP1. The second branch pipe 80*b* (see FIG. 9) disposed on the front side in an installation state is connected to the third liquid-side connection pipe L3 (see FIG. 1 and FIG. 2) communicating with the indoor units 40*c*, 40*d*, and the like, installed in the object space SP2.

An installation site of the second branch pipe unit 60 and a configuration mode and configuration part of each trap portion T1 are instructed through an installation manual, or the like, to a serviceman who performs installation.

(6) With Regard to Installation of Second Branch Pipe Unit 60

The second branch pipe unit 60 is carried into an installation site in a state of being preassembled. The second branch pipe unit 60 is installed by being joined with other connection pipes (CP1, CP2) on an installation site. At this time, each branch pipe 80 is cut as needed so as to be adapted to an installation environment, or the like, and is then joined with the other connection pipes. An installation method for the second branch pipe unit 60 is instructed through an installation manual, or the like, to a serviceman who performs installation.

(7) Characteristics (7-1)

With the air-conditioning system 100 according to the above-described embodiments, a decrease in reliability is minimized in relation to performing gas-liquid two-phase transfer.

As for refrigerant that is transferred through a liquid-side refrigerant passage running between an outdoor unit and indoor units, it is possible to perform operation with a smaller amount of refrigerant filled (the amount of refrigerant filled in a refrigerant circuit) in the case of gas-liquid two-phase transfer to transfer refrigerant in a gas-liquid two-phase state as compared to the case of liquid transfer to transfer refrigerant in a liquid state, so employing the gas-liquid two-phase transfer is regarded as a method of achieving refrigerant saving. However, in the case where the amount of refrigerant filled is reduced by performing gas-liquid two-phase transfer, when some of the indoor units are in an operating state and the other indoor units are in an operation stop state (a state where an operation start command is not input or an operation suspension state, such as thermo-off), it is presumable that the amount of circulating refrigerant is not normally ensured in the indoor units in an operating state (operating indoor units) and, as a result, reliability decreases. In other words, since the amount of refrigerant filled when gas-liquid two-phase transfer is performed is less than the amount of refrigerant filled when liquid transfer is performed, when refrigerant to be fed to the operating indoor units flows from a branch part into indoor-side connection pipes that communicate with the indoor units in an operation stop state (non-operating indoor units), it is presumable that the amount of circulating refrigerant is not normally ensured in the operating indoor units and, as a result, reliability decreases.

The air-conditioning system 100 in the above-described embodiments is the air-conditioning system 100 that performs a refrigeration cycle in the refrigerant circuit RC, and includes the outdoor unit 10, the plurality of indoor units 40, and the liquid-side connection pipe La (which corresponds to the "connection pipe"). The liquid-side connection pipe La is disposed between the outdoor unit 10 and the indoor units 40 and at least forms a refrigerant passage through which refrigerant in a gas-liquid two-phase state flows. The liquid-side connection pipe La includes the liquid-side branch parts BPa (which correspond to the "branch portions") and the trap portions T1. Each liquid-side branch part BPa includes the branch pipe group 88 (which corresponds to the "indoor-side pipe group"). The branch pipe group 88 is made up of the plurality of branch pipes 80 (which correspond to the "indoor-side pipes") each communicating with any one or some of the indoor units 40. Each liquid-side branch part BPa diverges refrigerant flowing from the outdoor unit 10 side. Each trap portion T1 is provided in the associated branch pipe 80 (that is, each trap portion T1 is provided in at least any one of the branch pipes 80). The trap portions T1 are filled with refrigerant in a gas state.

With the air-conditioning system 100, in the air-conditioning system 100 in which refrigerant passes in a gas-liquid two-phase state through the liquid-side connection pipe La connecting the outdoor unit 10 and the indoor units 40, the trap portion T1 is provided in each of the branch pipes 80 included in the liquid-side connection pipe La (the liquid-side branch part BPa). Thus, in the case where the amount of refrigerant filled is reduced as compared to the existing one by performing gas-liquid two-phase transfer, when part of the indoor units (operating indoor units) are in an operating state and the other indoor units (stopped indoor units) are in an operation stop state, gas refrigerant is filled in the trap portions T1 (of the branch pipes 80 communicating with the stopped indoor units). As a result, the flow of refrigerant to the stopped indoor units is suppressed. Thus, a shortage of the amount of circulating refrigerant in the operating indoor units is avoided. Therefore, a decrease in reliability is minimized in relation to performing gas-liquid two-phase transfer.

(7-2)

The air-conditioning system 100 according to the above-described embodiments includes the outdoor second control valve 17 (which corresponds to the "pressure reducing valve") that decompresses refrigerant such that refrigerant flowing from the outdoor unit 10 to the indoor units 40 passes through the liquid-side connection pipe La in a gas-liquid two-phase state. Thus, gas-liquid two-phase transfer can be simply realized.

(7-3)

In the air-conditioning system 100 according to the above-described embodiments, the indoor units 40 include the indoor units 40*a*, 40*b* (which correspond to the "first indoor units") and the indoor units 40*c*, 40*d* (which correspond to the "second indoor units") of which the installation level is lower than the installation level of the indoor units 40*a*, 40*b*. Each branch pipe group 88 (which corresponds to the "indoor-side pipe group") includes the first branch pipe 80*a* (which corresponds to the "first indoor-side pipe") and the second branch pipe 80*b* (which corresponds to the "second indoor-side pipe"). The first branch pipe 80*a* communicates with the indoor units 40*a*, 40*b*. The second branch pipe 80*b* communicates with the indoor units 40*c*, 40*d*. The trap portion T1 is provided in the second branch pipe 80*b*.

Thus, particularly, even when the indoor unit-side connection pipe CP2 communicating with the stopped indoor units communicates with the indoor unit-side connection pipe CP2 including a part of which the installation level is lower or the gradient is greater than the indoor unit-side connection pipe CP2 communicating with the operating indoor units, the flow of refrigerant in the second branch pipe 80*b* connected to the indoor unit-side connection pipe CP2 communicating with the stopped indoor units is suppressed. As a result, the flow of refrigerant to the stopped indoor units is appropriately suppressed.

(7-4)

In the air-conditioning system 100 according to the above-described embodiments, the liquid-side connection pipe La (which corresponds to the "connection pipe") includes the plurality of liquid-side branch parts BPa (which correspond to the "branch portions"). The trap portion T1 is provided in each of the branch pipes 80 included in the liquid-side branch part BPa (liquid-side branch part BL1) closest to the outdoor unit 10. Thus, a shortage of the amount of circulating refrigerant in the operating indoor units is particularly avoided. In other words, in the case where a plurality of the liquid-side branch parts BPa is disposed, when refrigerant does not flow as assumed in the liquid-side branch part BL1 closest to the outdoor unit 10, the amount of refrigerant flowing to the stopped indoor units side (the branch pipe 80 communicating with the stopped indoor units) increases, with the result that the amount of circulating refrigerant in the operating indoor units particularly easily runs short. In other words, the trap portions T1 are disposed at the liquid-side branch part BL1 closest to the outdoor unit 10, so the flow of refrigerant into the stopped indoor units side is particularly suppressed, and a shortage of the amount of circulating refrigerant in the operating indoor units is particularly avoided.

(7-5)

In the air-conditioning system 100 according to the above-described embodiments, each trap portion T1 has the upright portion V1 (which corresponds to the "upward extended portion"). The upright portion V1 extends upward. The upright portion V1 is disposed in the associated branch pipe 80 (which corresponds to the "outdoor-side pipe").

(7-6)

The air-conditioning system 100 according to the above-described embodiments includes the second branch pipe unit 60 (which corresponds to the "branch pipe unit"). The second branch pipe unit 60 is preassembled and connected to other pipes (here, the outdoor unit-side connection pipe CP1 and the indoor unit-side connection pipes CP2) on an installation site. The second branch pipe unit 60 is a component of the liquid-side branch part BPa. The second branch pipe unit 60 includes the main pipe 70 (which corresponds to the "outdoor-side pipe") and the connection pipe portion 90 (which corresponds to the "connection pipe"). The main pipe 70 communicates with the branch pipe group 88 (which corresponds to the "indoor-side pipe group"). The main pipe 70 is located on the outdoor unit 10 side with respect to the branch pipe group 88 in the refrigerant circuit RC. The connection pipe portion 90 connects the main pipe 70 and the branch pipe group 88. The connection pipe portion 90 diverges refrigerant, flowing from the main pipe 70, to the branch pipe group 88. The extending direction of each of the main pipe 70 and the connection pipe portion 90 is a horizontal direction.

When the thus configured second branch pipe unit 60 is used, the trap portions T1 can be easily made on an installation site. Therefore, even when the liquid-side connection pipe La is installed in a narrow space like the ceiling space SPa, time and effort required for work to provide the trap portions T1 are reduced, so improvement in installability is facilitated.

(8) Modifications

The above-described embodiments may be modified as needed as shown in the following modifications. Each of the modifications may be applied in combination with another modification without any contradiction.

(8-1) First Modification

In the second branch pipe unit 60 in the above-described embodiments, each of the branch pipes 80 (the first branch pipe 80*a* and the second branch pipe 80*b*) included in the branch pipe group 88 includes the first extended portion 81, the second extended portion 82, the turnaround portion 83, the third extended portion 84, and the fourth extended portion 85. In other words, in each of the branch pipes 80, the upright portion V1 (that is, the trap portion T1) is disposed. However, each of the branch pipes 80 does not necessarily need to include the first extended portion 81, the second extended portion 82, the turnaround portion 83, the third extended portion 84, and the fourth extended portion 85. In other words, the upright portion V1 (that is, the trap portion T1) does not necessarily need to be disposed in each of the branch pipes 80.

Figure 10:
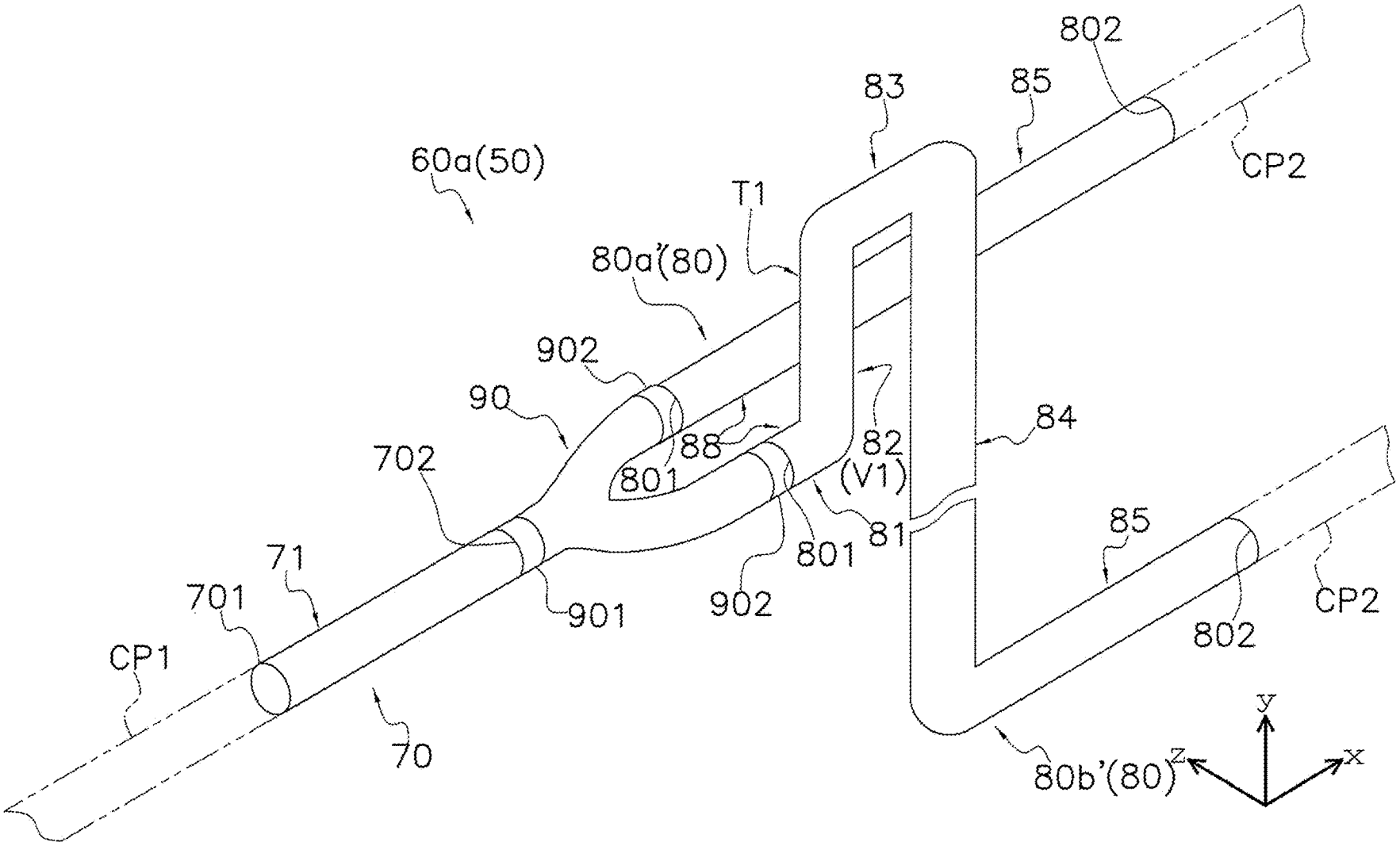
FIG. 10 is a schematic configuration diagram of a second branch pipe unit according to a first modification.

For example, the second branch pipe unit 60 may be configured as in the case of a second branch pipe unit 60*a* (which corresponds to the "branch pipe unit") shown in FIG. 10. FIG. 10 is a schematic configuration diagram of the second branch pipe unit 60*a*. The alternate long and two-short dashed line arrows in FIG. 10 represent a direction in which refrigerant flows during normal cycle operation. Hereinafter, portions of the second branch pipe unit 60*a*, different from the portions of the second branch pipe unit 60, will be described.

The second branch pipe unit 60*a* includes a first branch pipe 80*a*' and a second branch pipe 80*b*' instead of the first branch pipe 80*a* and the second branch pipe 80*b*. The first branch pipe 80*a*', different from the first branch pipe 80*a*, does not include the first extended portion 81, the second extended portion 82, the turnaround portion 83, or the third extended portion 84. In relation to this, in the first branch pipe 80*a*', the upright portion V1 (that is, the trap portion T1) is not provided.

In the second branch pipe 80*b*', the dimension in the y direction of the third extended portion 84 is greater than that of the second branch pipe 80*b*. In relation to this, in an installation state, the installation level of each of the fourth extended portion 85 and the indoor unit-side connection pipe CP2 connected to the fourth extended portion 85 is lower than that of the first branch pipe 80*a*'. In other words, the second branch pipe 80*b*' is lower in installation level than the first branch pipe 80*a*'. In other words, the second branch pipe unit 60*a* is configured such that the trap portion T1 is provided in the branch pipe 80 (second branch pipe 80*b*') including a portion of which the installation level is lower than that of the other branch pipe 80 (first branch pipe 80*a*') of the branch pipe group 88 (which corresponds to the "indoor-side pipe group").

In the case where the thus configured second branch pipe unit 60*a* is disposed instead of the second branch pipe unit 60 as well, when part of the indoor units 40 are in an operating state and the other indoor units 40 are in an operation stop state, the trap portion T1 (of the second branch pipe 80*b*' communicating with the stopped indoor units) is filled with gas refrigerant. Particularly, in the case where the branch pipe 80 (here, the second branch pipe 80*b*') communicating with the stopped indoor units is lower in installation level than the branch pipe 80 (here, the first branch pipe 80*a*') communicating with the operating units or in the case where the branch pipe 80 (here, the second branch pipe 80*b*') communicating with the stopped indoor units has a greater negative gradient portion than the branch pipe 80 (here, the first branch pipe 80*a*') communicating with the operating units, the flow of refrigerant into the branch pipe 80 (second branch pipe 80*b*') communicating with the stopped indoor units is appropriately suppressed. As a result, the flow of refrigerant to the stopped indoor units communicating with the second branch pipe 80*b*' is suppressed. Thus, a shortage of the amount of circulating refrigerant in the operating indoor units communicating with the first branch pipe 80*a*' is avoided.

When the second branch pipe unit 60*a* is used, the trap portion T1 can be easily made on an installation site. Therefore, even when the liquid-side connection pipe La is installed in a narrow space, time and effort required for work to provide a trap are reduced, so improvement in installability is facilitated.

The point that the upright portion V1 (that is, the trap portion T1) does not need to be disposed in each of the branch pipes 80 also applies to second branch pipe units 60*b* to 60*g* (see FIG. 11 to FIG. 18) (described later).

(8-2) Second Modification

Figure 11:
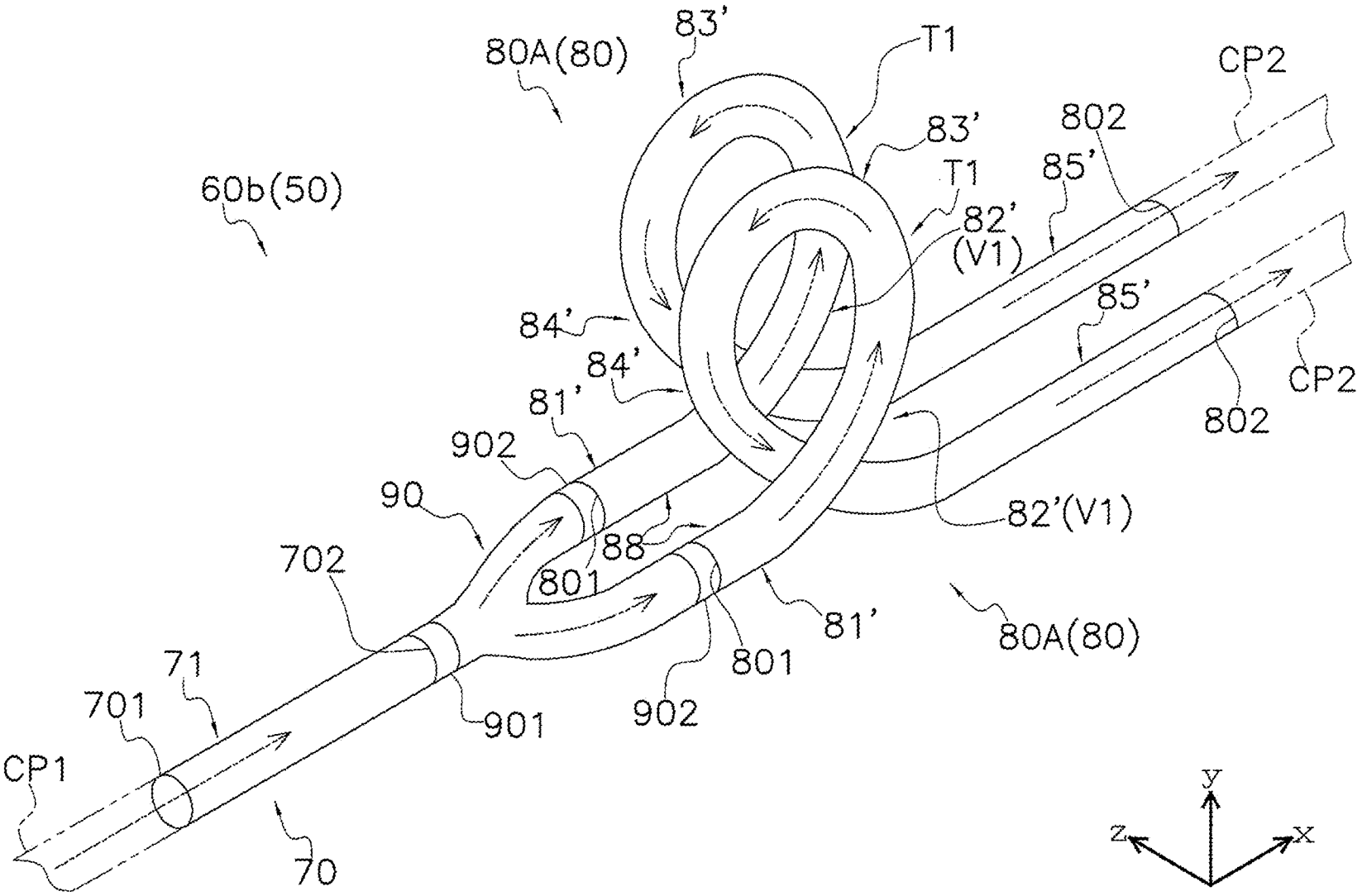
FIG. 11 is a schematic configuration diagram of a second branch pipe unit according to a second modification.

The second branch pipe unit 60 may be configured as in the case of, for example, the second branch pipe unit 60*b* shown in FIG. 11. FIG. 11 is a schematic configuration diagram of the second branch pipe unit 60*b*. The alternate long and two-short dashed line arrows in FIG. 11 represent a direction in which refrigerant flows during normal cycle operation. Hereinafter, portions of the second branch pipe unit 60*b*, different from the portions of the second branch pipe unit 60, will be described.

In the second branch pipe unit 60*b*, the branch pipe group 88 includes branch pipes 80A instead of the branch pipes 80. Each branch pipe 80A, different from the branch pipe 80, includes a first extended portion 81', a second extended portion 82', a turnaround portion 83', a third extended portion 84', and a fourth extended portion 85'. In the branch pipe 80A, the inclination angle of the second extended portion 82' with respect to the x direction is less than that of the second extended portion 82 of the branch pipe 80. The inclination angle of the third extended portion 84' with respect to the x direction is less than that of the third extended portion 84 of the branch pipe 80. In relation to this, the branch pipe 80A turns around in a spiral shape. In other words, the first extended portion 81', second extended portion 82', turnaround portion 83', third extended portion 84', and fourth extended portion 85' of the branch pipe 80A are made so as to turn 360 degrees between one end 801 and the other end 802, and the trap portion T1 including the upright portion V1 is made in relation to this.

In the case where the thus configured second branch pipe unit 60*b* is disposed instead of the second branch pipe unit 60 as well, when part of the indoor units 40 are in an operating state and the other indoor units 40 are in an operation stop state, the trap portion T1 (of the branch pipe 80A communicating with the stopped indoor units) is filled with gas refrigerant. As a result, the flow of refrigerant to the stopped indoor units communicating with the branch pipe 80A is suppressed. Thus, a shortage of the amount of circulating refrigerant in the operating indoor units can be avoided.

When the second branch pipe unit 60*b* is used, the trap portions T1 can be easily made on an installation site. Therefore, even when the liquid-side connection pipe La is installed in a narrow space, time and effort required for work to provide a trap are reduced, so improvement in installability is facilitated.

(8-3) Third Modification

Figure 12:
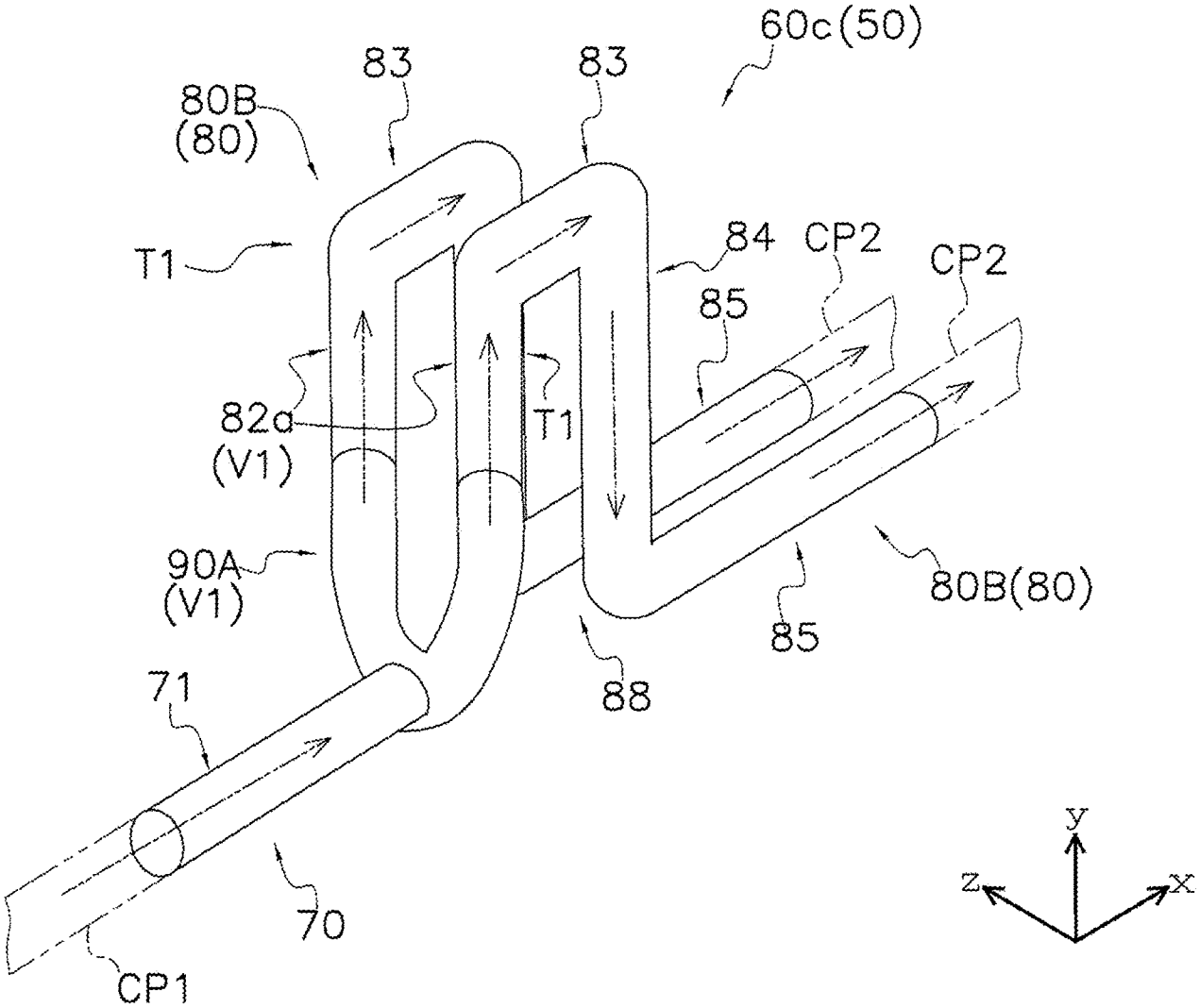
FIG. 12 is a schematic configuration diagram of a second branch pipe unit according to a third modification.

The second branch pipe unit 60 may be configured as in the case of, for example, the second branch pipe unit 60*c* shown in FIG. 12. FIG. 12 is a schematic configuration diagram of the second branch pipe unit 60*c*. The alternate long and two-short dashed line arrows in FIG. 12 represent a direction in which refrigerant flows during normal cycle operation. Hereinafter, portions of the second branch pipe unit 60*c*, different from the portions of the second branch pipe unit 60, will be described.

The second branch pipe unit 60*c* includes a connection pipe portion 90A instead of the connection pipe portion 90. The connection pipe portion 90A, different from the connection pipe portion 90, is disposed so as to extend in the y direction (that is, a direction that intersects with the extending direction of the main pipe 70 and in an upward direction in an installation state). In other words. the connection pipe portion 90A is connected to the main pipe 70 and the branch pipe group 88 in substantially a U-shape or substantially a C-shape when viewed in the x direction.

In the second branch pipe unit 60*c*, the branch pipe group 88 includes branch pipes 80B instead of the branch pipes 80. Each branch pipe 80B, different from the branch pipe 80, does not include the first extended portion 81. The branch pipe 80B includes a second extended portion 82*a* of which the dimension in the y direction is less than that of the second extended portion 82, instead of the second extended portion 82.

In the second branch pipe unit 60*c*, the upright portions V1 and the trap portions T1 are made up of the connection pipe portion 90A together with the branch pipes 80B.

In other words, in the second branch pipe unit 60*c*, the extending direction of the main pipe 70 (which corresponds to the "outdoor-side pipe") is the x direction (a horizontal direction in an installation state), the extending direction of the connection pipe portion 90A (which corresponds to the "connection pipe") is the y direction (a vertical direction in an installation state, and each upright portion V1 (which corresponds to the "upward extended portion") is disposed over the connection pipe portion 90A and the associated branch pipes 80B (which correspond to the "indoor-side pipes"). When the thus configured second branch pipe unit 60*c* is disposed instead of the second branch pipe unit 60 as well, similar advantageous effects to those according to the above-described embodiments are obtained. In other words, when the trap portions T1 are made up of the branch pipes and the connection pipe portion as well, a decrease in reliability related to two-phase transfer is minimized.

When the second branch pipe unit 60*c* is used, the trap portions T1 can be easily made on an installation site. Therefore, even when the liquid-side connection pipe La is installed in a narrow space, time and effort required for work to provide a trap are reduced, so improvement in installability is facilitated.

(8-4) Fourth Modification

Figure 13:
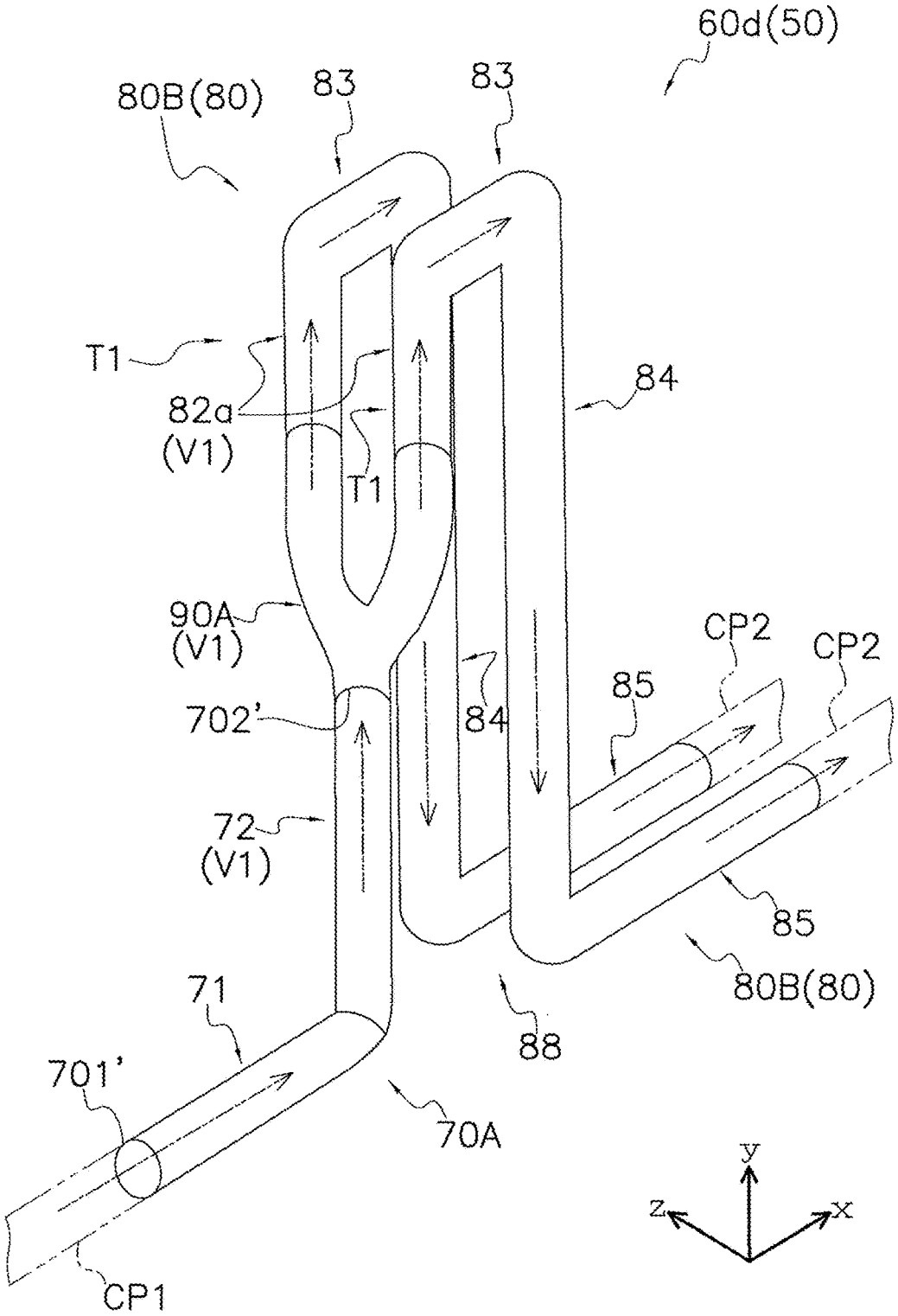
FIG. 13 is a schematic configuration diagram of a second branch pipe unit according to a fourth modification.

The second branch pipe unit 60*c* may be configured as in the case of, for example, the second branch pipe unit 60*d* shown in FIG. 13. FIG. 13 is a schematic configuration diagram of the second branch pipe unit 60*d*. The alternate long and two-short dashed line arrows in FIG. 13 represent a direction in which refrigerant flows during normal cycle operation. Hereinafter, portions of the second branch pipe unit 60*d*, different from the portions of the second branch pipe unit 60*c*, will be described.

The second branch pipe unit 60*d* includes a main pipe 70A instead of the main pipe 70. The main pipe 70A includes a first main pipe portion 71 extending along the x direction (the "horizontal direction" in an installation state) and a second main pipe portion 72 extending along the y direction (the "vertical direction" in an installation state). A terminal of the first main pipe portion 71 is one end 701' of the main pipe 70A, and is connected to the outdoor unit-side connection pipe CP1 in an installation state. A distal end of the first main pipe portion 71 is connected to a terminal of the second main pipe portion 72. The second main pipe portion 72 is located between the first main pipe portion 71 and a set of the connection pipe portion 90A and the second extended portions 82*a*. A distal end of the second main pipe portion 72 is the other end 702' of the main pipe 70A and is connected to the connection pipe portion 90A. In other words, the main pipe 70A extends from one end 701' along the x direction, then extends in the y direction, and is connected to the connection pipe portion 90A. In relation to this, in the second branch pipe unit 60*d*, the upright portion V1 and the trap portions T1 are made up of the branch pipes 80B, the connection pipe portion 90A, and the main pipe 70A (second main pipe portion 72).

In other words, in the second branch pipe unit 60*d*, the extending direction of each of the main pipe 70A (which corresponds to the "outdoor-side pipe") and the connection pipe portion 90A (which corresponds to the "connection pipe") is the y direction (the vertical direction in an installation state), and the upright portion V1 (which corresponds to the "upward extended portion") is disposed over the main pipe 70A, the connection pipe portion 90A, and the associated branch pipes 80B (which correspond to the "indoor-side pipes"). When the thus configured second branch pipe unit 60*d* is disposed instead of the second branch pipe unit 60 as well, similar advantageous effects to those according to the above-described embodiments are obtained. In other words, when the trap portions T1 are made up of the branch pipes, the connection pipe portion, and the main pipe as well, a decrease in reliability related to two-phase transfer is minimized. When the second branch pipe unit 60*d* is used, the trap portions T1 can be easily made on an installation site. Therefore, even when the liquid-side connection pipe La is installed in a narrow space, time and effort required for work to provide a trap are reduced, so improvement in installability is facilitated.

Figure 14:
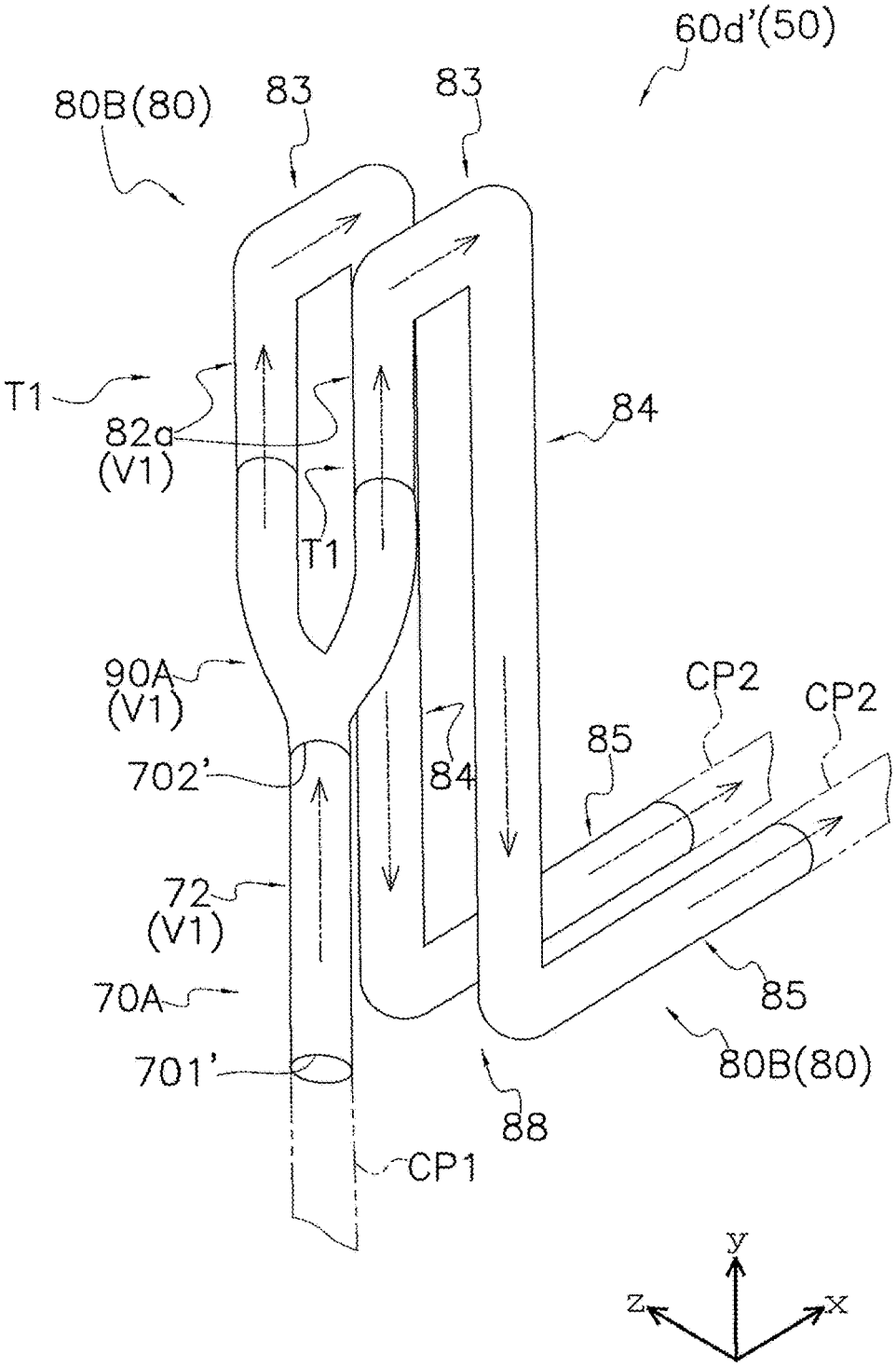
FIG. 14 is a schematic configuration diagram of another example on the second branch pipe unit according to the fourth modification.

In the second branch pipe unit 60*d*, the first main pipe portion 71 in the main pipe 70A may be omitted as in the case of a second branch pipe unit 60*d'* shown in FIG. 14. In this case, a terminal of the second main pipe portion 72 is one end 701' of the main pipe 70A, and is connected to the outdoor unit-side connection pipe CP1 in an installation state.

(8-5) Fifth Modification

Figure 15:
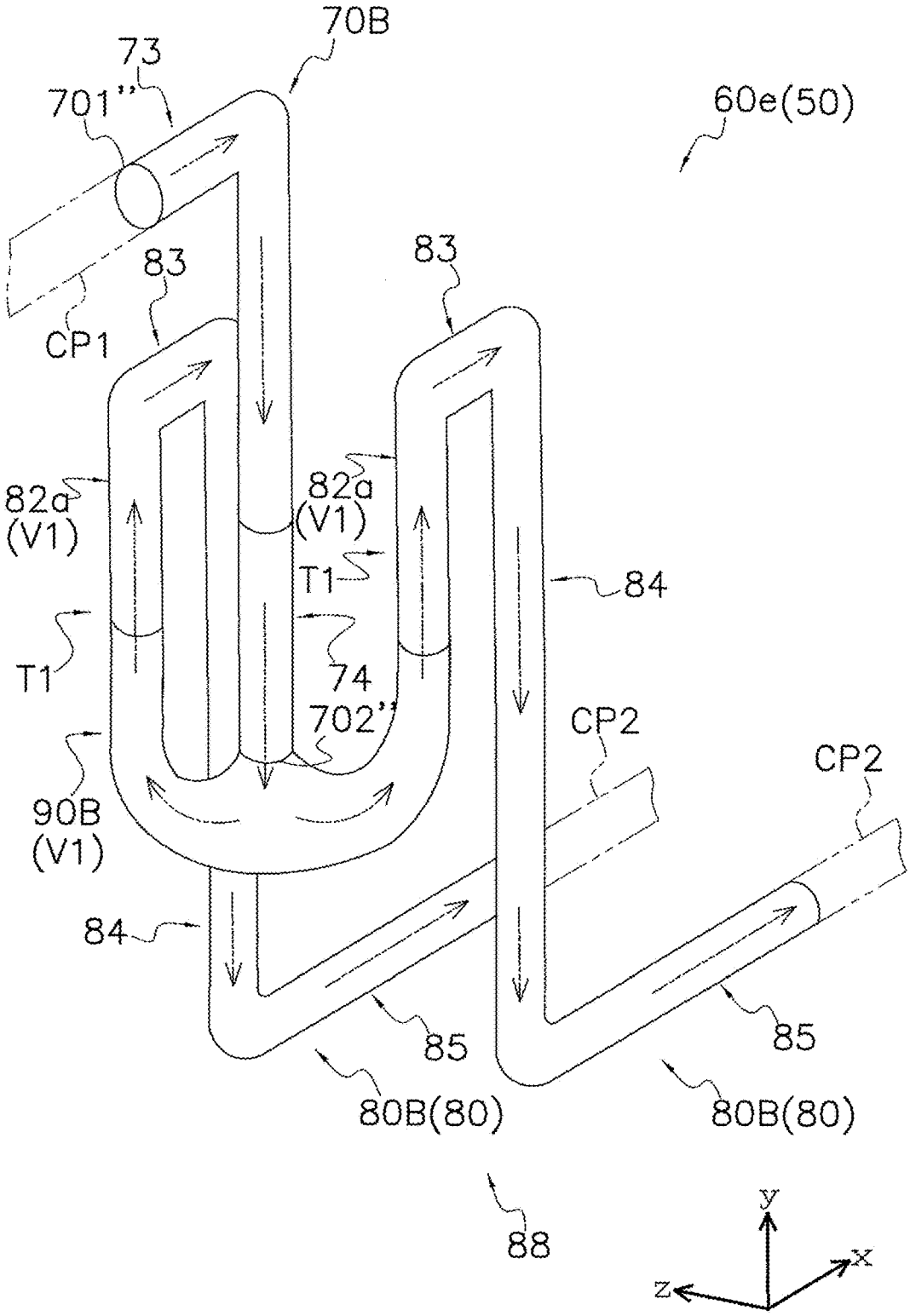
FIG. 15 is a schematic configuration diagram of a second branch pipe unit according to a fifth modification.

The second branch pipe unit 60*d* may be configured as in the case of, for example, the second branch pipe unit 60*e* shown in FIG. 15. FIG. 15 is a schematic configuration diagram of the second branch pipe unit 60*e*. The alternate long and two-short dashed line arrows in FIG. 15 represent a direction in which refrigerant flows during normal cycle operation. Hereinafter, portions of the second branch pipe unit 60*e*, different from the portions of the second branch pipe unit 60*d*, will be described.

The second branch pipe unit 60*e* includes a main pipe 70B instead of the main pipe 70A and includes a connection pipe portion 90B instead of the connection pipe portion 90A.

The main pipe 70B includes a third main pipe portion 73 extending along the x direction (horizontal direction in an installation state) and then extending along the y direction (downward direction in an installation state), and a fourth main pipe portion 74 extending along the y direction (downward direction in an installation state) on the branch pipe group 88 side with respect to the third main pipe portion 73. A terminal of the third main pipe portion 73 is one end 701' of the main pipe 70B, and is connected to the outdoor unit-side connection pipe CP1 in an installation state. A distal end of the third main pipe portion 73 is connected to a terminal of the fourth main pipe portion 74. A distal end of the fourth main pipe portion 74 is the other end 702" of the main pipe 70B and is connected to the connection pipe portion 90B (between both end portions 902' of the connection pipe portion 90B). In other words, the main pipe 70B extends from one end 701' along the x direction, then extends in the y direction, and is connected to the connection pipe portion 90B at the other end 702".

Figure 16:
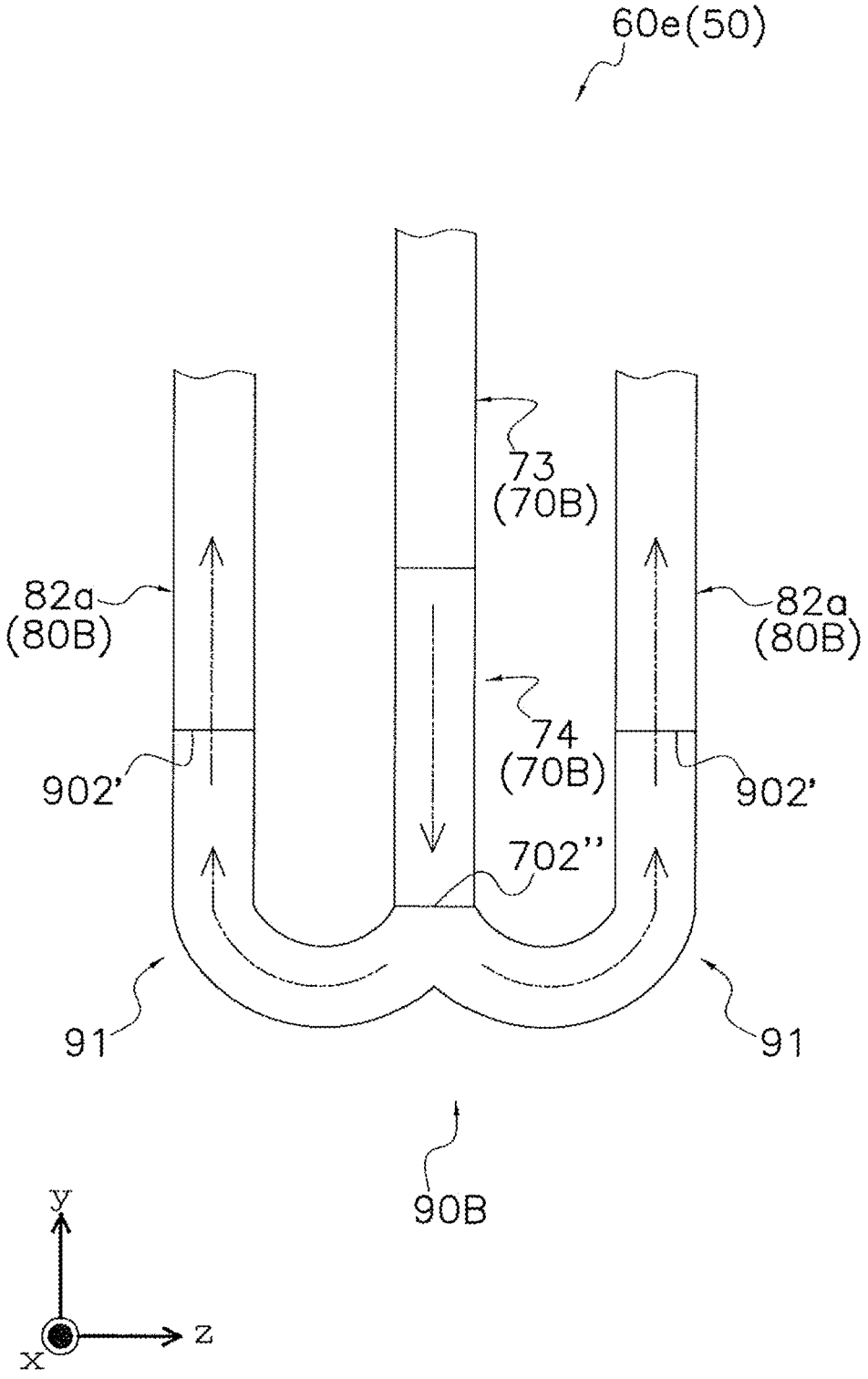
FIG. 16 is an enlarged view around a connection pipe portion in the second branch pipe unit according to the fifth modification.

FIG. 16 is an enlarged view around the connection pipe portion 90B in the second branch pipe unit 60*e*. As shown in FIG. 16, the connection pipe portion 90B extends along the x direction and/or the z direction (horizontal direction in an installation state) and diverges according to the number of the branch pipes 80B included in the branch pipe group 88, and includes connection pipe extended portions 91 (which correspond to the "turnaround portions") that turn around to the y direction (upward direction in an installation state) at the branched end portions and extend, and that are connected to the second extended portions 82*a* of the branch pipes 80B. Each connection pipe extended portion 91 is a portion that turns refrigerant, flowing from the main pipe 70B, around to the upward direction in the second branch pipe unit 60*e*. The connection pipe portion 90B includes a plurality of end portions 902', and each end portion 902' is connected to the second extended portion 82*a* of any one of the branch pipes 80B. The connection pipe portion 90B connects terminals (main pipe 70B-side end portions) of the branch pipes 80B included in the branch pipe group 88.

In the second branch pipe unit 60*e*, the upright portions V1 and the trap portions T1 are made up of the branch pipes 80B and the connection pipe portion 90B (connection pipe extended portions 91).

In other words, in the second branch pipe unit 60*e*, the main pipe 70B (which corresponds to the "outdoor-side pipe") extends along the y direction (downward direction in an installation state), the connection pipe portion 90B (which corresponds to the "connection pipe") includes the connection pipe extended portions 91 (which correspond to the "turnaround portions") that turn refrigerant, flowing from the main pipe 70B, around to the upward direction, and the upright portion V1 (which corresponds to the "upward extended portion") is disposed over the connection pipe portion 90B and the associated branch pipes 80B (which correspond to the "indoor-side pipes"). When the thus configured second branch pipe unit 60*e* is disposed instead of the second branch pipe unit 60 as well, similar advantageous effects to those according to the above-described embodiments are obtained. In other words, when the trap portions T1 are made up of the branch pipes and the connection pipe portion as well, a decrease in reliability related to two-phase transfer is minimized.

When the second branch pipe unit 60*e* is used, the trap portions T1 can be easily made on an installation site. Therefore, even when the liquid-side connection pipe La is installed in a narrow space, time and effort required for work to provide a trap are reduced, so improvement in installability is facilitated.

(8-6) Sixth Modification

Figure 17:
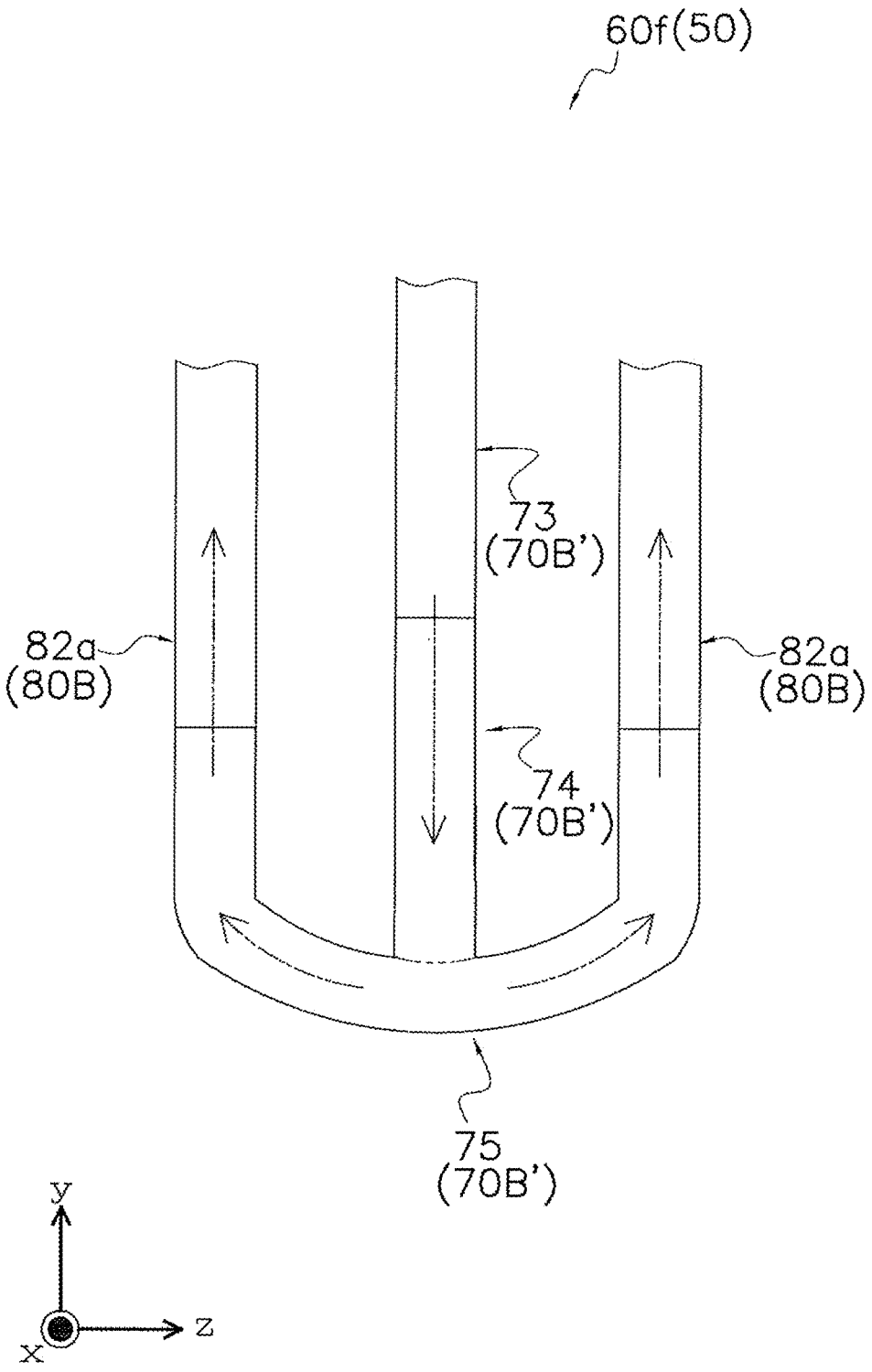
FIG. 17 is an enlarged view around a connection pipe portion in a second branch pipe unit according to a sixth modification.

The second branch pipe unit 60*e* may be configured as in the case of, for example, the second branch pipe unit 60*f* shown in FIG. 17. FIG. 17 is a schematic configuration diagram of the second branch pipe unit 60*f*. The alternate long and two-short dashed line arrows in FIG. 17 represent a direction in which refrigerant flows during normal cycle operation. Hereinafter, portions of the second branch pipe unit 60*f*, different from the portions of the second branch pipe unit 60*e*, will be described.

In the second branch pipe unit 60*f*, different from the second branch pipe unit 60*e*, the connection pipe portion 90B is omitted. The second branch pipe unit 60*f* includes a main pipe 70B' instead of the main pipe 70B. The main pipe 70B' includes a fifth main pipe portion 75 in addition to the third main pipe portion 73 and the fourth main pipe portion 74. The fifth main pipe portion 75 is a portion that extends in the y direction (downward direction in an installation state) on the branch pipe group 88 side with respect to the third main pipe portion 73, then extends along the x direction and/or the z direction (horizontal direction in an installation state) and diverges according to the number of the branch pipes 80B included in the branch pipe group 88, turn around to the y direction (upward direction in an installation state) at the branched end portions, and are connected to the second extended portions 82*a* of the branch pipes 80B. In the second branch pipe unit 60*f*, the fifth main pipe portion 75 includes a portion extending along the x direction.

The fourth main pipe portion 74 is located on the outdoor unit 10 side with respect to the fifth main pipe portion 75 in the liquid-side connection circuit RC3*a* in an installation state. In the second branch pipe unit 60*f*, in an installation state, refrigerant flowing from the outdoor unit 10 to the indoor units 40 flows along the downward direction in the fourth main pipe portion 74.

With the thus configured second branch pipe unit 60*f* as well, similar advantageous effects to those in the case where the second branch pipe unit 60*e* is used.

(8-7) Seventh Modification

Figure 18:
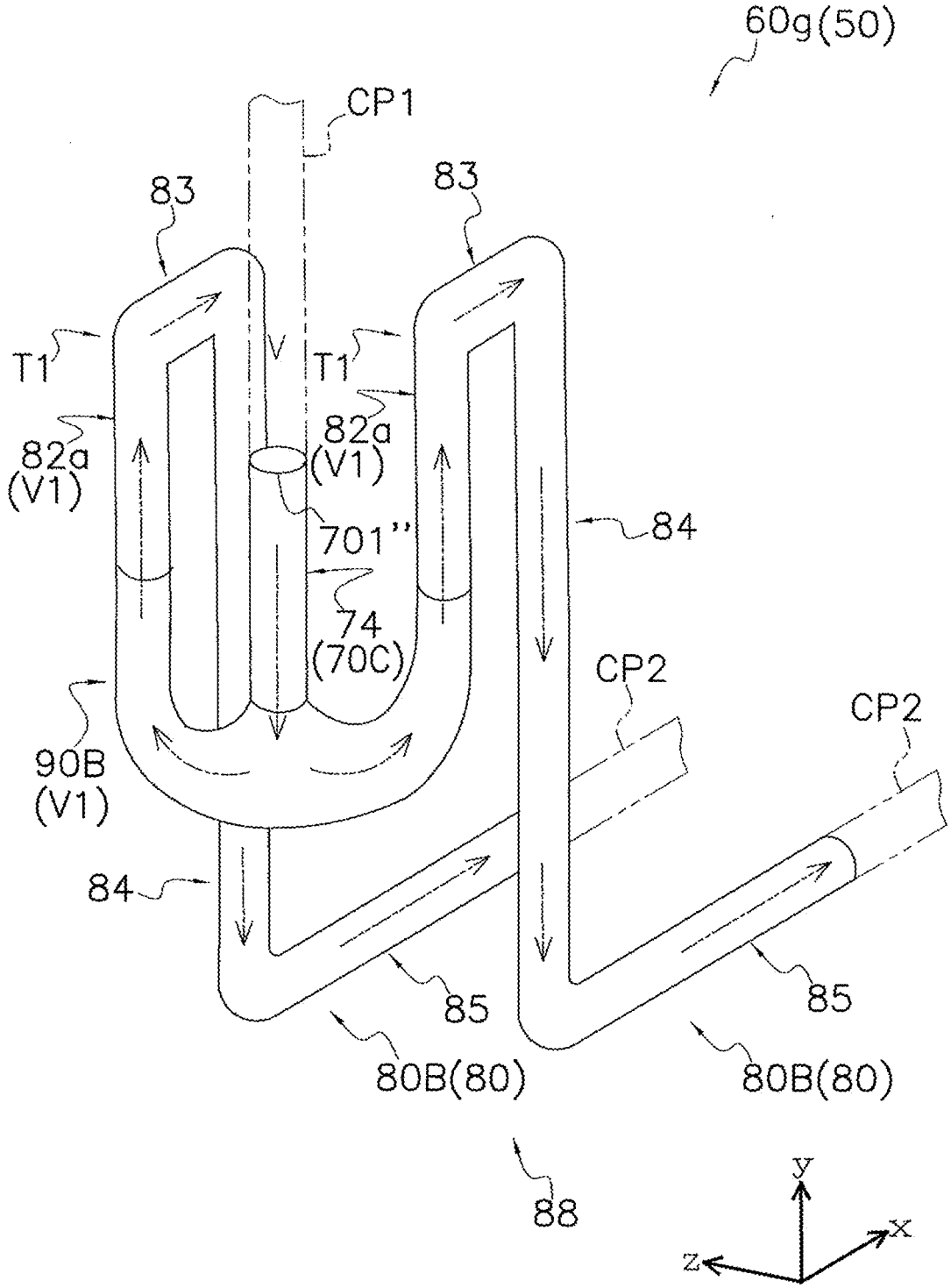
FIG. 18 is a schematic configuration diagram of a second branch pipe unit according to a seventh modification.

The second branch pipe unit 60*e* may be configured as in the case of, for example, the second branch pipe unit 60*g* shown in FIG. 18. FIG. 18 is a schematic configuration diagram of the second branch pipe unit 60*g*. The alternate long and two-short dashed line arrows in FIG. 18 represent a direction in which refrigerant flows during normal cycle operation. Hereinafter, portions of the second branch pipe unit 60*g*, different from the portions of the second branch pipe unit 60*e*, will be described.

The second branch pipe unit 60*g* includes a main pipe 70C instead of the main pipe 70B. In the main pipe 70C, different from the main pipe 70B, the third main pipe portion 73 is omitted. In relation to this, a terminal of the fourth main pipe portion 74 is one end 701' of the main pipe 70C, and is connected to the outdoor unit-side connection pipe CP1 in an installation state.

In the second branch pipe unit 60*g*, as well as the second branch pipe unit 60*e*, the upright portions V1 and the trap portions T1 are made up of the branch pipes 80B and the connection pipe portion 90B. When the second branch pipe unit 60*g* is disposed instead of the second branch pipe unit 60 as well, similar advantageous effects to those according to the above-described embodiments are obtained. In other words, when the trap portions T1 are made up of the branch pipes, the connection pipe portion, and the main pipe as well, a decrease in reliability related to two-phase transfer is minimized (8-8) Eighth Modification In the above-described embodiments, the case where the liquid-side branch part BL1 that is the liquid-side branch part BPa closest to the outdoor unit 10 is made up of the second branch pipe unit 60 is described. However, the branch part BP made up of the second branch pipe unit 60 just needs to be selected as needed in light of the necessity of making a trap portion T1 according to design specifications or an installation environment. For example, any one or some or all of the liquid-side branch parts BL2, BL3, BL4, BL5, BL6, and the like, shown in FIG. 2, may be made up of the second branch pipe unit 60.

(8-9) Ninth Modification

The second extended portion 82 does not necessarily need to extend at right angles with respect to the extending direction of the first extended portion 81 or the main pipe 70. In other words, the inclination angle of the second extended portion 82 with respect to the extending direction of the first extended portion 81 or the main pipe 70 may be an angle less than 90 degrees. For example, the second extended portion 82 may extend along the y direction at an inclination angle of 30 degrees to 60 degrees with respect to the extending direction of the first extended portion 81 or the main pipe 70.

(8-10) Tenth Modification

In the above-described embodiments, the second branch pipe unit 60 is made by joining the separate main pipe 70, connection pipe portion 90, and branch pipes 80 with one another. However, the second branch pipe unit 60 may be made by integrally forming some or all of the main pipe 70, the connection pipe portion 90, and the branch pipes 80. For example, the second branch pipe unit 60 may be made by bending a single pipe. Alternatively, for example, the second branch pipe unit 60 may be made by joining a plurality of pipes with one another.

(8-11) Eleventh Modification

The mode of configuration of each of the main pipe 70, connection pipe portion 90, and branch pipes 80 included in the second branch pipe unit 60 may be selected as needed. In other words, each of the main pipe 70, connection pipe portion 90, and branch pipes 80 may be made by bending a single pipe or may be made by joining a plurality of pipes with one another.

(8-12) Twelfth Modification

In the above-described embodiments, the case where the second branch pipe unit 60 makes up the whole of the predetermined branch part BP is described. However, the second branch pipe unit 60 does not necessarily need to make up the whole of the branch part BP and may make up only part of the branch part BP. In other words, the second branch pipe unit 60 may make up the branch part BP together with another pipe(s) (for example, any one or some or all of the outdoor unit-side connection pipe CP1 and the indoor unit-side connection pipes CP2, or another pipe unit).

(8-13) Thirteenth Modification

In the above-described embodiments, the case where the second branch pipe unit 60 is carried to an installation site in a preassembled state is described. However, the configuration is not limited thereto. The second branch pipe unit 60 may be assembled by joining or cutting parts on an installation site. For example, the second branch pipe unit 60 may be assembled by joining any one or some or all of the main pipe 70, connection pipe portion 90, and branch pipes 80 in a state of being separated from other portions, with the other portions on an installation site. Alternatively, for example, the second branch pipe unit 60 may be assembled by cutting any one or some or all of the main pipe 70, connection pipe portion 90, and branch pipes 80 on an installation site as needed.

Alternatively, for example, any one or some of all of the portions included in the main pipe 70 may be assembled by being joined with another one of the parts included in the main pipe 70 on an installation site. Alternatively, for example, any one or some or all of the portions included in the main pipe 70 may be assembled by cutting on an installation site as needed.

Alternatively, for example, any one or some or all of the portions included in the connection pipe portion 90 may be assembled by being joined with another portion included in the main pipe 70 on an installation site. Alternatively, for example, any one or some or all of the portions included in the connection pipe portion 90 may be assembled by cutting on an installation site as needed.

Alternatively, for example, any one or some or all of the portions (for example, 81 to 85) included in each branch pipe 80 may be assembled by being joined with another portion included in the main pipe 70 on an installation site. Alternatively, for example, any one or some or all of the portions (for example, 81 to 85) included in each branch pipe 80 may be assembled by cutting on an installation site as needed.

(8-14) Fourteenth Modification

In the above-described embodiments, the case where each branch pipe 80 is made up of the first extended portion 81, the second extended portion 82, the turnaround portion 83, the third extended portion 84, and the fourth extended portion 85 is described. However, the mode of configuration of each branch pipe 80 is not necessarily limited thereto, and modification is applicable as needed without any contradiction from the operation and advantageous effects in the above-described embodiments (that is, when part of the indoor units 40 are in an operating state and the other indoor units 40 are in an operation stop state, the trap portion T1 of the branch pipe 80 communicating with the stopped indoor units is filled with gas refrigerant). For example, each branch pipe 80 does not need to include any one or some or all of the first extended portion 81, the turnaround portion 83, the third extended portion 84, and the fourth extended portion 85. Alternatively, for example, each branch pipe 80 may additionally include a portion other than the first extended portion 81, the turnaround portion 83, the third extended portion 84, or the fourth extended portion 85.

(8-15) Fifteenth Modification

In the above-described embodiments, the case where each branch pipe 80 has a size of greater than or equal to two eighths and less than or equal to six eighths is described. In terms of this point, the inside diameter and/or outside diameter of the branch pipe 80 does not necessarily need to be uniform from one end to the other end and may have a portion that partially expands or contracts.

(8-16) Sixteenth Modification

In the above-described embodiments, the x direction corresponds to the right-left direction in an installation state, and the z direction corresponds to the front-rear direction in an installation state. However, the configuration is not limited thereto, and the x direction may correspond to the front-rear direction in an installation state, and the z direction may correspond to the right-left direction in an installation state.

(8-17) Seventeenth Modification

The installation mode of the second branch pipe unit 60 shown in FIG. 7 is only illustrative and may be modified as needed according to design specifications or an installation environment. For example, the second branch pipe unit 60 may be installed by being inverted in the front-rear direction, inverted in the right-left direction, and/or inverted in the up-down direction from the installation mode of FIG. 7 as needed.

(8-18) Eighteenth Modification

In the above-described embodiments, in the second branch pipe unit 60, the branch pipe group 88 includes the two branch pipes 80 (80*a*, 80*b*). Alternatively, the branch pipe group 88 may include three or more branch pipes 80. In this case, the upright portion V1 (which corresponds to the "upward extended portion") just needs to be provided in a predetermined one or more of the branch pipes 80 as needed according to design specifications or an installation environment.

(8-19) Nineteenth Modification

The mode of configuration of the refrigerant circuit RC in the above-described embodiments is not necessarily limited to the mode shown in FIG. 1 and may be modified as needed according to design specifications or an installation environment.

For example, the outdoor first control valve 16 is not necessarily required and may be omitted as needed. In this case, the outdoor second control valve 17 may be caused to provide the function of the outdoor first control valve 16 during reverse cycle operation.

For example, the outdoor second control valve 17 is not necessarily required to be disposed in the outdoor unit 10 and may be disposed outside the outdoor unit 10 (for example, in the liquid-side connection pipe La).

For example, the indoor expansion valve 41 is not necessarily required to be disposed in the indoor unit 40 and may be disposed outside the indoor unit 40 (for example, in the liquid-side connection pipe La).

For example, the subcooler 15 or the outdoor third control valve 18 is not necessarily required and may be omitted as needed. Alternatively, a device not shown in FIG. 1 may be newly added.

Alternatively, for example, in the refrigerant circuit RC, a refrigerant passage switching unit that switches the flow of refrigerant into each indoor unit 40 may be disposed between the outdoor unit 10 and each indoor unit 40 in order to make it possible to individually perform normal cycle operation and reverse cycle operation for each indoor unit 40.

(8-20) Twentieth Modification

In the air-conditioning system 100 according to the above-described embodiments, the plurality of (four or more) indoor units 40 is connected in series or parallel to the single outdoor unit 10 by the connection pipes (Ga, La). In terms of this point, the number of the outdoor units 10 and/or the number of the indoor units 40 and the mode of connection may be modified as needed according to an installation environment or design specifications. For example, a plurality of the outdoor units 10 may be arranged in series or parallel with each other.

(8-21) Twenty-First Modification

In the above-described embodiments, R32 is used as a refrigerant that circulates through the refrigerant circuit RC. Alternatively, a refrigerant that is used in the refrigerant circuit RC is not limited and may be another refrigerant. For example, in the refrigerant circuit RC, HFC-series refrigerant, such as R407C and R410A, may be used.

(8-22) Twenty-Second Modification

In the above-described embodiments, ideas according to the present invention are applied to the air-conditioning system 100. However, not limited thereto, the ideas according to the present invention may also be applied to another refrigeration apparatus (for example, a water heater, a heat pump chiller, or the like) having a refrigerant circuit.

(8-23) Twenty-Third Modification

In the above-described embodiments, the second branch pipe unit 60 is applied to the air-conditioning system 100 that performs gas-liquid two-phase transfer during normal cycle operation. However, the second branch pipe unit 60 is not necessarily avoided to be applied to an air-conditioning system that performs liquid transfer.

(8-24) Twenty-Fourth Modification

In the above-described embodiments, in the air-conditioning system 100, the outdoor second control valve 17 is used as a device that realizes gas-liquid two-phase transfer. Alternatively, gas-liquid two-phase transfer may be realized by using another device instead of the outdoor second control valve 17 or in addition to the outdoor second control valve 17. In other words, the outdoor second control valve 17 is not necessarily required and may be omitted as needed.

For example, gas-liquid two-phase transfer may be performed by controlling the opening degree of the outdoor first control valve 16. Alternatively, for example, another control valve not shown in FIG. 1 may be disposed in the refrigerant circuit RC (particularly, a passage on a liquid side with respect to the outdoor heat exchanger 14), and gas-liquid two-phase transfer may be performed by controlling the opening degree of the control valve. Alternatively, for example, gas-liquid two-phase transfer may be performed by disposing a capillary tube, or the like, in the refrigerant circuit RC (particularly, a passage on a liquid side with respect to the outdoor heat exchanger 14) and decompressing refrigerant.

In this case, the pipe length (particularly, the length from the outdoor unit 10 to the trap portion T1) of the liquid-side connection pipe La is recorded in advance, and the status of refrigerant may be controlled such that refrigerant flows in a gas-liquid two-phase state through the liquid-side connection pipe La according to the pipe length. In other words, when the pipe length (particularly, the length from the outdoor unit 10 to the trap portion T1) of the liquid-side connection pipe La is known, the status (pressure or temperature) of refrigerant flowing out from the outdoor unit 10 may be controlled based on a pressure loss, or the like, in the liquid-side connection pipe La so as to be in a gas-liquid two-phase state on the upstream side of the trap portion T1.

(9)

The present invention is usable in an air-conditioning system.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10 outdoor unit
40 indoor unit
40*a*, 40*b* indoor unit (first indoor unit)
40*c*, 40*d* indoor unit (second indoor unit)
50 branch pipe unit

51 first branch pipe unit
60, 60*a* to 60*g* second branch pipe unit
70, 70A, 70B, 70B', 70C main pipe
71 first main pipe portion
72 second main pipe portion
73 third main pipe portion
74 fourth main pipe portion
75 fifth main pipe portion
80, 80A, 80B branch pipe (indoor-side pipe)
80*a*, 80*a*' first branch pipe (first indoor-side pipe)
80*b*, 80*b*' second branch pipe (second indoor-side pipe)
81, 81' first extended portion
82, 82', 82*a* second extended portion
83, 83' turnaround portion
84, 84' third extended portion
85, 85' fourth extended portion
88 branch pipe group (indoor-side pipe group)
90, 90A, 90B connection pipe portion (second connection pipe)
91 connection pipe extended portion (turnaround portion)
95 heat insulating material
100 air-conditioning system
701, 701', 701" one end of the main pipe
702, 702', 702" the other end of the main pipe
801 one end of the branch pipe
802 the other end of the branch pipe
901 first connection portion
902 second connection portion
902' end portion of the connection pipe portion
B1 building
BP branch part
BPa, BL1 to BL6 liquid-side branch part (branch portion)
BPb gas-side branch part
C1 ceiling space bottom surface
C2 ceiling space top surface
CP1 outdoor unit-side connection pipe (first connection pipe)
CP2 indoor unit-side connection pipe (first connection pipe)
G gas accumulation
Ga gas-side connection pipe
G1 to G5 first gas-side connection pipe to fifth gas-side connection pipe
La liquid-side connection pipe (first connection pipe)
L1 to L5 first liquid-side connection pipe to fifth liquid-side connection pipe
P1 to P14 first pipe to fourteenth pipe
RC refrigerant circuit
RC1 outdoor-side circuit
RC2 indoor-side circuit
RC3 connection circuit
RC3*a* liquid-side connection circuit (refrigerant passage)
RC3*b* gas-side connection circuit
SP, SP1, SP2 object space
SPa ceiling space
T1 trap portion
V1 upright portion (upward extended portion)

PATENT LITERATURE

PTL 1 International Publication No. 2015/029160

The invention claimed is:

1. An air-conditioning system that performs a refrigeration cycle in a refrigerant circuit, the air-conditioning system comprising:
- an outdoor unit;
- a plurality of indoor units; and
- a first connection pipe disposed between the outdoor unit and the indoor units and that forms at least a refrigerant passage through which refrigerant in a gas-liquid two-phase state flows, wherein
- the outdoor unit comprises a pressure reducing valve that decompresses refrigerant such that refrigerant flowing to the indoor units passes through the first connection pipe in the gas-liquid two-phase state,
- the first connection pipe comprises:
  - a branch portion that:
    - comprises an indoor-side pipe group comprising indoor-side pipes that each communicate with any one of the indoor units, and
    - diverges refrigerant flowing from the outdoor unit; and
  - a trap portion disposed in at least any one of the indoor-side pipes and is filled with refrigerant in a gas state,
- the trap portion comprises:
  - a first pipe portion that extends substantially vertical;
  - a second pipe portion that extends substantially horizontal and that is connected to the first pipe portion; and
  - a third pipe portion that extends substantially vertical and that is connected to the second pipe portion.

2. The air-conditioning system according to claim 1, wherein the trap portion is disposed in one of the indoor-side pipes having an installation level lower than an installation level of another of the indoor-side pipes.

3. The air-conditioning system according to claim 1, wherein
- the plurality of indoor units comprises:
  - a first indoor unit; and
  - a second indoor unit, wherein
  - an installation level of the second indoor unit is lower than an installation level of the first indoor unit,
- the indoor-side pipe group comprises:
  - a first indoor-side pipe that communicates with the first indoor unit; and
  - a second indoor-side pipe that communicates with the second indoor unit, and the trap portion is disposed in the second indoor-side pipe.

4. The air-conditioning system according to claim 1, wherein
- the first connection pipe comprises a plurality of the branch portions, and
- the trap portion is disposed in the indoor-side pipe included in the branch portion closest to the outdoor unit.

5. The air-conditioning system according to claim 1, wherein
- the first pipe portion, the second pipe portion, and third pipe portion form an upward extended portion that extends upward, and
- the upward extended portion is disposed in an associated one of the indoor-side pipes.

6. The air-conditioning system according to claim 5, wherein
- the branch portion comprises a branch pipe unit preassembled and connected to another pipe on an installation site,
- the branch pipe unit comprises:
  - an outdoor-side pipe that communicates with the indoor-side pipe group and is disposed toward the outdoor unit with respect to the indoor-side pipe group in the refrigerant circuit; and a second connection pipe that:

connects the outdoor-side pipe with the indoor-side pipe group, and diverges refrigerant that flows from the outdoor-side pipe to the indoor-side pipe group, and an extending direction of each of the outdoor-side pipe and the second connection pipe is a horizontal direction.

7. The air-conditioning system according to claim 5, wherein:

the branch portion comprises a branch pipe unit preassembled and connected to another pipe on an installation site, the branch pipe unit comprises:

an outdoor-side pipe that communicates with the indoor-side pipe group and is disposed toward the outdoor unit with respect to the indoor-side pipe group in the refrigerant circuit; and a second connection pipe that:

connects the outdoor-side pipe with the indoor-side pipe group, and diverges refrigerant that flows from the outdoor-side pipe to the indoor-side pipe group, an extending direction of each of the outdoor-side pipe and the second connection pipe is a vertical direction, and the upward extended portion is disposed over the outdoor-side pipe, the second connection pipe, and the associated one of the indoor-side pipes.

8. The air-conditioning system according to claim 5, wherein:

the branch portion comprises a branch pipe unit preassembled and connected to another pipe on an installation site, the branch pipe unit comprises:

an outdoor-side pipe that communicates with the indoor-side pipe group and is disposed toward the outdoor unit with respect to the indoor-side pipe group in the refrigerant circuit; and a second connection pipe that:

connects the outdoor-side pipe with the indoor-side pipe group, and diverges refrigerant that flows from the outdoor-side pipe to the indoor-side pipe group, an extending direction of the outdoor-side pipe is a horizontal direction, an extending direction of the second connection pipe is a vertical direction, and the upward extended portion is disposed over the second connection pipe and the associated one of the indoor-side pipes.

9. The air-conditioning system according to claim 5, wherein:

the branch portion comprises a branch pipe unit preassembled and connected to another pipe on an installation site, the branch pipe unit comprises:

an outdoor-side pipe that communicates with the indoor-side pipe group and is disposed toward the outdoor unit with respect to the indoor-side pipe group in the refrigerant circuit; and a second connection pipe that:

connects the outdoor-side pipe with the indoor-side pipe group, and diverges refrigerant that flows from the outdoor-side pipe to the indoor-side pipe group, the outdoor-side pipe extends along a downward direction, the second connection pipe comprises a turnaround portion that turns refrigerant, flowing from the outdoor-side pipe, around to an upward direction, and the upward extended portion is disposed over the second connection pipe and the associated one of the indoor-side pipes.

* * * * *